US009205008B2

(12) United States Patent
Meiki

(10) Patent No.: US 9,205,008 B2
(45) Date of Patent: Dec. 8, 2015

(54) ARTICULATED THERAPEUTIC APPARATUS AND METHOD

(76) Inventor: Rani Meiki, Maalot-Tarsheha (IL)

( * ) Notice: Subject to any disclaimer, the term of this patent is extended or adjusted under 35 U.S.C. 154(b) by 53 days.

(21) Appl. No.: 13/984,838

(22) PCT Filed: Feb. 21, 2012

(86) PCT No.: PCT/IL2012/000086

§ 371 (c)(1),
(2), (4) Date: Aug. 9, 2013

(87) PCT Pub. No.: WO2012/114332

PCT Pub. Date: Aug. 30, 2012

(65) Prior Publication Data

US 2013/0307298 A1 Nov. 21, 2013

Related U.S. Application Data

(60) Provisional application No. 61/457,305, filed on Feb. 22, 2011.

(51) Int. Cl.

| | |
|---|---|
| ***A61G 13/00*** | (2006.01) |
| ***A47C 9/00*** | (2006.01) |
| ***A61G 5/10*** | (2006.01) |
| ***A61G 7/015*** | (2006.01) |
| ***A61G 7/16*** | (2006.01) |
| ***A61G 13/12*** | (2006.01) |
| ***A61G 15/00*** | (2006.01) |

(52) U.S. Cl.

CPC . *A61G 5/10* (2013.01); *A47C 9/005* (2013.01); *A61G 7/015* (2013.01); *A61G 7/16* (2013.01); *A61G 13/009* (2013.01); *A61G 13/1205* (2013.01); *A61G 13/1285* (2013.01); *A61G 15/007* (2013.01); *A61G 2200/325* (2013.01)

(58) Field of Classification Search

CPC . A61G 13/009; A61G 15/002; A61G 15/007; A61G 2200/325; A47C 9/005; A47C 9/025; A47C 2201/0149

USPC ..... 297/195.11, 215.13, 423.11, 423.12, 297/411.39, 68, 423.19

See application file for complete search history.

(56) References Cited

U.S. PATENT DOCUMENTS

| | | | | | |
|---|---|---|---|---|---|
| 5,401,078 | A * | 3/1995 | Riach | A47C 7/503 | 297/19 |
| 5,487,590 | A * | 1/1996 | Haynes | A61G 15/007 | 297/195.11 |
| D369,691 | S * | 5/1996 | Haynes | D6/335 | |
| 5,772,278 | A * | 6/1998 | Kowalski | 297/85 L | |
| 5,921,696 | A * | 7/1999 | Gillotti | A47C 9/005 | 24/270 |
| 5,931,535 | A * | 8/1999 | Sweet | 297/354.13 | |
| 5,971,485 | A * | 10/1999 | Clark | A61G 13/009 | 297/195.11 |
| 6,065,808 | A * | 5/2000 | Tinsley | A47C 9/005 | 297/195.11 |
| 6,390,546 | B1 | 5/2002 | Ming | | |
| 6,543,853 | B1 * | 4/2003 | Splane, Jr. | A61G 15/007 | 297/195.11 |
| 7,690,057 | B2 * | 4/2010 | Malassigne | A61G 1/0237 | 5/613 |
| 2002/0067060 | A1 * | 6/2002 | Lloyd | A47C 9/005 | 297/195.11 |

(Continued)

*Primary Examiner* — Ryan Kwiecinski
(74) *Attorney, Agent, or Firm* — Law Offices of Steven W. Weinrieb

(57) ABSTRACT

An apparatus is provided comprising a base, a seat, a torso rest, and leg supports for the right and left legs, respectively, of a patient placed on the therapy apparatus. The seat, torso rest, and leg supports may be connects to the base by a seat mechanism, torso mechanism and leg mechanisms, respectively. The seat mechanism, torso mechanism and leg mechanisms may be movable in a simultaneous and/or coordinated manner.

11 Claims, 22 Drawing Sheets

(56) References Cited

U.S. PATENT DOCUMENTS

2002/0101108 A1* 8/2002 Roleder ..... A47C 9/005
297/423.12
2003/0090131 A1* 5/2003 Roleder ..... A47C 9/005
297/195.11
2004/0070253 A1* 4/2004 Murphy ..... A61G 15/00
297/423.11
2005/0035644 A1* 2/2005 Lloyd ..... A47C 9/005
297/423.11
2007/0052275 A1* 3/2007 Ghilzai ..... A47C 1/06
297/423.12
2007/0120408 A1* 5/2007 Hsieh ..... A47C 7/54
297/411.39
2012/0158138 A1* 6/2012 Brinkerhoff ..... A61G 15/00
623/15.11

* cited by examiner

ARTICULATED THERAPEUTIC APPARATUS AND METHOD

FIELD OF THE DISCLOSURE

The present disclosure is mainly concerned with an articulated therapeutic apparatus generally of the kind used by, in a way of example, practitioners such as, but not limited to, chiropractors, physiotherapists and the like), medical staff, and therapists, such as, but not limited to, complementary and/or alternative medicine practitioners, in a variety of medical and/or para-medical operations, including, but not limited to, diagnosis, positioning, applying techniques (such as, but not limited to, manipulation and mobilization of patients and/or segmental movement), as well as to a method for using the same.

BACKGROUND

GB2149652 to Sprout Richard Michael & Blank Heinz Ingo (see FIG. 1a, "Prior Art", depicting FIGS. 1 and 2 of the above-cited publication) discloses " . . . (A) support surface indicated generally by numeral 2 comprises three distinct support members 21, 22 and 23 which are arranged along the length of the table in an end to end adjacent manner . . . . The support member 21 is located at the 'head' end 24 of the table and comprises a pair of rectangular cushions 25 and 26 which are spaced apart slightly on either side of the longitudinal axis of the table so as to provide a small gap 27 there between. This gap 27 serves to accommodate a patient's nose when lying on the table in the prone position . . . . The cushions 25 and 26 of this member 21 which is hereinafter referred to as the cervical support member, are mounted to a suitable mechanism which is hinged to the upper mechanism 7 along its end 28 thereby enabling the cervical support member 21 to be raised and lowered through a vertical angle . . . "

Another exemplary type of a therapeutic apparatus may comprise several main co-planar surfaces, which may be pivoted with respect to each other in the horizontal and/or vertical planes. As will be well appreciated by those skilled in the art, this enables one part of a patient's anatomy to be pivoted about another part and so as to enable the angular orientation of two or more sections of a person's anatomy to be changed, thereby making them more accessible or more amenable to application of various techniques.

A considerable portion of therapeutic apparatuses known in the art have been designed for specific operations, which make them unsuitable for use with a broad spectrum of therapeutic techniques. Thus a practitioner wishing to practice such a broad spectrum of techniques would be required the use of several types of the therapeutic apparatuses if he wishes to achieve good results.

Another aspect of handing patients, mostly disabled patients, is discussed in JP9075402 to Nakano Mikio & Nakagawa Takeo (see FIG. 1b, "Prior Art", depicting FIG. 3 of JP9075402) aiming " . . . To provide a table for care of a patient or handicapped which permits a person in care to make works with (a) lesser burden . . . ", (by providing a) " . . . table for care of a patient or handicapped (which) has a first attitude changing means A where the floor part 5 is supported on the base frame 1 to allow a user to lie thereon facing down and which changes him to the lower limbs bent attitude so that his knee joints and hip joint are bent and a second attitude changing means B which changes to the sitting attitude where his whole body is rising. A seat part is furnished to support the hip in the sitting attitude, and the floor part 5 is composed of a first floor section 7 to support the upper body including the face, breast, and belly of the user in lying situation facing down, a second floor section 8 to support the thighs, and a third floor section 9 to support the lower limbs and feet. The adjoining ends of these floor sections 7, 8, 9 are coupled together by pivoting, and the means A bends the sections 8, 9 relative to the section 7 so that an approx. L-form is generated when viewed in the side elevation, while the means B rotates the sections 7, 8, 9 in a single piece around (a) horizontal axis, and a notch 7g is formed at a part of the upper end part of the floor section 7 which copes with the face of the user lying facing down."

Posture of patients may be considered as a manner in which a patient's body is arranged and/or organized about the patient's vector of gravity. Thus, one possible aspect of posture may be related to the body part which bears the weight of the patient. In such cases, a possible outcome of posture change may be considered as changing the body part which bears the body weight of the patient.

Another aspect recently reported is the importance of using prone position in sleep and/or therapy. It is well known that at least certain aspects of therapy need to be conducted or carried out when the patient is in a prone position. Recently, at least one article was published portraying an importance of positioning people in a prone position: " . . . however, subjects who reported that they mostly slept in the prone position . . . were significantly less likely to report the presence of a medical condition which affected their sleep quality . . . " (Gordon, Grimmer, Trott, *Sleep Position, Age, Gender, Sleep Quality and Waking Cervico-Thoracic Symptoms*, The Internet Journal of Allied Health Sciences and Practice, Vol. 5 No. 1, 2007).

However, performing posture changes of patients, i.e., transferring patients to and/or from different positions and/or postures, may become rather daunting and demanding on nursing staff. One such posture change, all too common in nursing and health practices, may be turning, or rotation of a patient from a supine posture to a prone posture, and vice verse. *Intensive and Critical Care Nursing* (2001) published an article by McCormick and Blackwood, *Nursing the ARDS patient in the prone position* . . . stating in "techniques of Turning" that:

"Patients should be turned when they are (relatively) stable. The patient must be adequately sedated and is usually receiving muscle relaxants.

"A. Five staff are required to perform the maneuver. A doctor or experienced nurse, to manage the head and tracheal tube and co-ordinate the turn and two people each side of the patient."

Evidently, much care and resources need to be dedicated to the mere operation of turning the patient to and/or from the prone position.

An exemplary therapeutic apparatus specifically designed to rotate a patient to a prone position is the RotoProne™, which rotates a possibly unconscious patient from a supine to a prone position. Certainly, since a patient may be unconscious, such rotation must be initiated by the practitioner, with the patient being essentially passive. Further, RotoProne™ [(http://www.rotoprone.com/therapy.html)] state, on their web page, incorporated herein by reference, that " . . . The RotoProne™ Therapy System automates Prone Therapy and Kinetic Therapy for patients suffering from pulmonary complications associated with immobility. Automating these therapies can help manage the patient-handling risks associated with manual proning." Moreover, RotoProne™ state that "Multiple Clinical Studies [(see http://www.rotoprone.com/studies.html)] have demonstrated that Prone Therapy can provide:

"Rapid Oxygenation within the first hour of pronation[11,12]

"Significant Improvements in Oxygenation[2,11]

"Decreased Ventilator Associated Lung Injury[3,6,7]

Clinical Studies have also demonstrated that Prone Therapy may provide:

"Reduction in Ventilator Days[2,5]

"Reduction in Length of Stay[2,5]"

However, the system discussed above requires strapping down the patient: to quote News story aired on WOAI TV [(see http://www.rotoprone.com/videos/woai.html, (incorporated herein by reference, in its entirety)] " . . . Here is how it works—Patients are tightly strapped in from head to toe. The machine pivots the patient face down . . . " (leaving them, effectively, hanging on the strapping) and with a rigid surface (which was initially used to support the patient in a supine posture) blocking any access to the patient's rear—a prerequisite of many therapeutic procedures, so that these therapeutic operations may be severely hampered.

While, admittedly, prone positioning may be, at least, beneficial in administering therapy, or may even be necessary to practice and/or apply certain modalities of physical therapies, there remains yet a long—felt need to transferring patients to and/or from a prone position.

SUMMARY

The present disclosure may relate to a articulated therapeutic apparatus generally of the kind which may be used, as an illustrative example, but not limited to, by therapists, such as chiropractors, physiotherapists and the like, in the diagnosis, manipulation, therapy and/or treatment and/or positioning and/or mobilization of patients; however, other types of articulated therapeutic apparatuses, such as, but not limited to, those that are intended to be utilized in the diagnosis, manipulation and mobilization of patients, in general, may also be included in the scope and spirit of the present disclosure. The present disclosure may be further directed to a method of utilization and/or usage of such apparatuses.

It may be desirable to provide an articulated therapeutic apparatus of increased versatility.

It would be desirable to have an apparatus that, when attempting to move a patient between positions, would do it easily.

According to an aspect of the present disclosure an apparatus may comprise a base, a seat, a torso rest, and leg supports for the right and left legs, respectively, of a patient placed on the apparatus, the seat, torso rest, and leg supports may connect to the base by a seat mechanism, torso mechanism and leg mechanisms, respectively, wherein the seat mechanism, torso mechanism and leg mechanisms may be movable in a simultaneous and/or coordinated manner.

Possibly, a seat mechanism may connect the seat to a base spine extending from a first end to a second end adjacent the first end, a leg mechanism may be disposed forwardly relative to the seat mechanism and may interlink the leg supports and the base spine, and a torso mechanism may connect the torso rest and may be hinged to the base spine about a pelvic hinge.

Optionally, the apparatus may comprise arm rests connected to a torso mechanism and movable in a simultaneous and/or coordinated manner with the torso, seat, and leg mechanisms.

Possibly, the seat mechanism may be operated by a seat actuator, the torso mechanism may be operated by a torso actuator, and the leg mechanisms may be actuated by one leg actuator. Alternatively, the leg mechanisms may be each operated by a leg actuator.

Further possibly, the seat, torso and leg actuator(s) may operate in a simultaneous and/or coordinated manner.

Optionally, the leg mechanisms may be operated by a single leg actuator.

Alternatively, the leg mechanisms may be operated by two leg actuators.

Optionally, the torso mechanism may comprise a lug extending generally transversely thereto from an abdomen member away from an abdomen rest to a first linkage hinge, a leg linkage extending between the first linkage hinge and a second linkage hinge linking the lug with the leg mechanisms, so that when moved, a simultaneous and/or coordinated movement between the torso mechanism and the leg mechanisms may be effected.

Potentially, movement of the torso mechanism may be effected by a torso actuator which may be connected between a base spine and the torso mechanism, movement of the leg mechanisms may be effected to move with the torso mechanism through the movement of the lug and the leg linkage linking the lug to the leg mechanism, and motion of the seat mechanism may be effected by a seat actuator generally connected between the base spine and a seat mechanism.

Optionally, the apparatus may comprise arm support mechanism hinged to the torso mechanism adjacent to the head member thereof, the arm support mechanism comprises a rearward arm member, a forward arm member, and an intermediate arm member, the intermediate arm member being linked with the seat mechanism by a second linkage system transferring and/or coordinate motion between the intermediate arm member and the seat mechanism.

Possibly, the apparatus may comprise a coordinating linkage extending between, and hingedly join, a forward coordinating hinge linked to a rearward link member of the leg support system and a rearward coordinating hinge linked with the seat mechanism so that movement of a torso mechanism may be effected by a torso actuator connected between a base spine and the torso mechanism.

Alternatively, movement of a torso mechanism and its coordinated seat mechanism may be effected by a seat actuator connected between the base spine and the seat mechanism.

Optionally, the seat mechanism, torso mechanism and leg mechanism may move continuously between a seated position and a prone position.

Further optionally, a prone extent of the apparatus in the prone position is greater compared to a seated extent when the apparatus is in the seated position.

Further alternatively, movement of a torso mechanism and its coordinated seat mechanism may be effected by a leg actuator connected between the base spine and the leg support system.

Yet further alternatively, movement of a torso mechanism and its coordinated seat mechanism may be effected by a coordinating actuator connected between the base spine and the coordinating linkage.

According to another aspect of the present disclosure, a method for an assisted change of a position of a patient is disclosed, the method comprising steps of:

A. Providing an apparatus having at least a base, a seat, a torso rest, and leg supports, with the seat, torso rest, and leg supports may be connected to the base by a seat mechanism, torso mechanism and leg mechanisms, respectively, B. Locating a patient on the apparatus with a torso of the patient facing the torso rest, patient's buttocks rest on the seat, and with segments of a right and a left leg of the patient lean against sections of a right and a left leg support, respectively. And C. Transferring the patient from any position to a desired position while placed on the apparatus with the seat mechanism, torso mechanism and leg mechanisms being movable in a simultaneous and/or coordinated manner.

Possibly, such transfer may be effected with the patient remaining passive.

In addition to the exemplary aspects and embodiments described above, further aspects and embodiments will become apparent by reference to the figures and by study of the following detailed descriptions.

BRIEF DESCRIPTION OF EXEMPLARY DRAWINGS

Exemplary and/or illustrative embodiments of the present disclosure will be presented herein below by way of example only, and may become more fully understood from the detailed description and the accompanying schematic illustrations, wherein:

FIG. 1*a* is a prior-art sketch taken from GB2149652;

FIG. 1*b* is a prior-art sketch taken from JP9075402;

Figure 20:
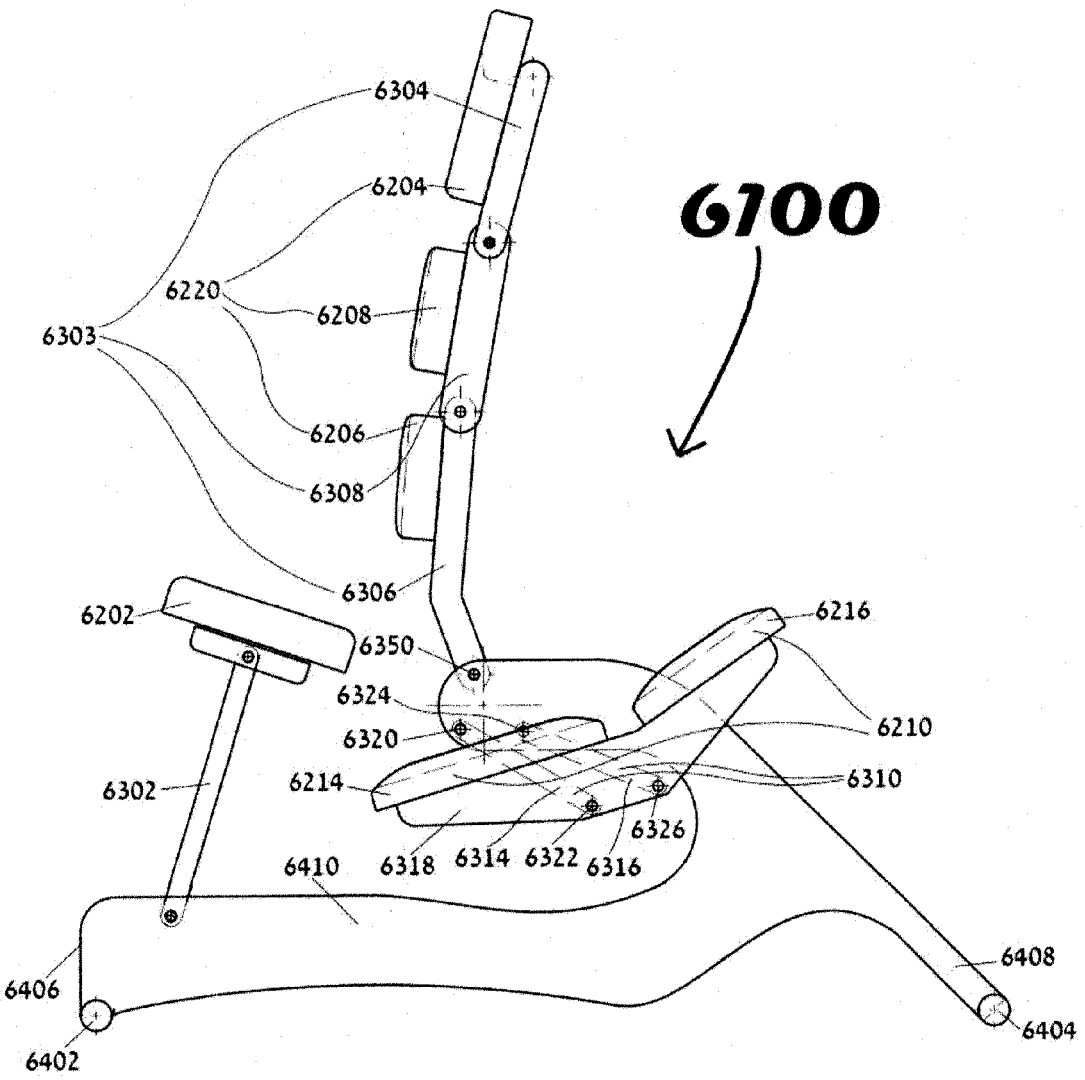
Figure 21:
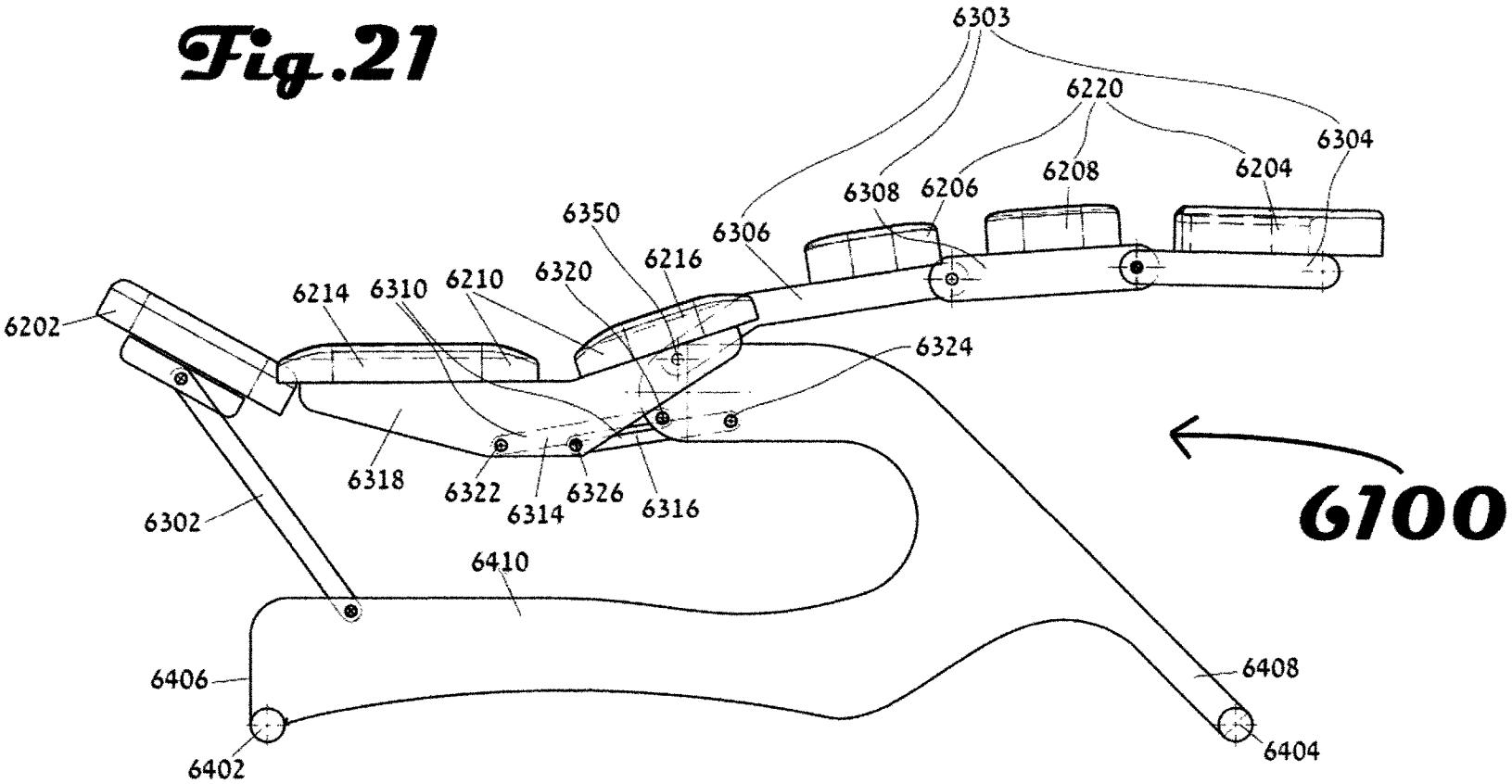

FIG. 20 is a schematic illustration showing a right side elevation view of a seventh of several possible, exemplary, neither exhaustive nor limiting embodiments, of an modified therapeutic apparatus according to the present disclosure, in which the seventh modified therapeutic apparatus may be seen in a seated position; and FIG. 21 is a schematic illustration showing a right side elevation view of the seventh modified therapeutic apparatus shown in FIG. 20, in which the sixth therapeutic apparatus may be seen in a prone position.

DETAILED DESCRIPTION

As required, a schematic, exemplary embodiment of the present apparatus and method are disclosed herein; however, it is to be understood that the disclosed embodiment is merely exemplary of the present disclosure, which may be embodied in various and/or alternative forms. The figures are not necessarily to scale, and some features may be exaggerated or minimized and/or roughly shown and/or omitted entirely, to show details of particular components. Hence, specific structural and functional details disclosed herein are not to be interpreted as limiting, but merely as a basis for the claims and as a representative basis for teaching one skilled in the art to variously employ the present disclosure in virtually any appropriately detailed structure.

Figure 1A:
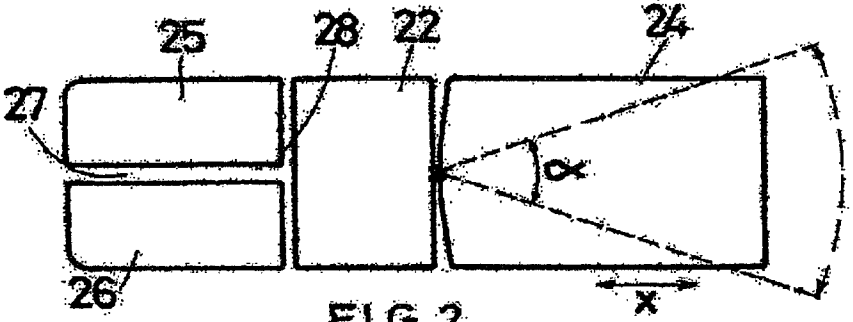
Fig. 1a Prior Art
Figure 2:
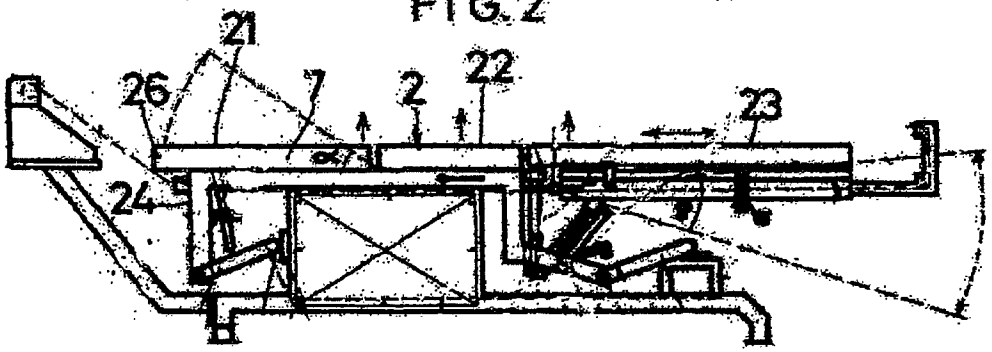
FIG. 2 is a schematic perspective illustration of a first of several possible, exemplary, but not exhaustive or limiting embodiments of an articulated therapeutic apparatus according to the present disclosure, where a seated position of the first articulated therapeutic apparatus may be seen.
Figure 1B:
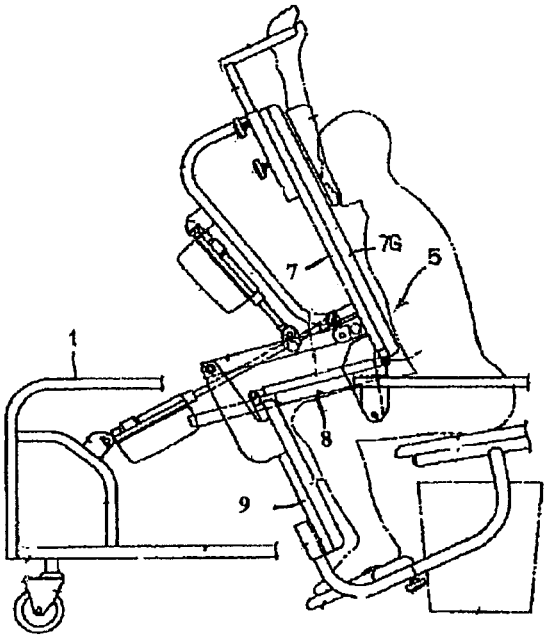
Fig. 1b Prior Art
Figure 2:
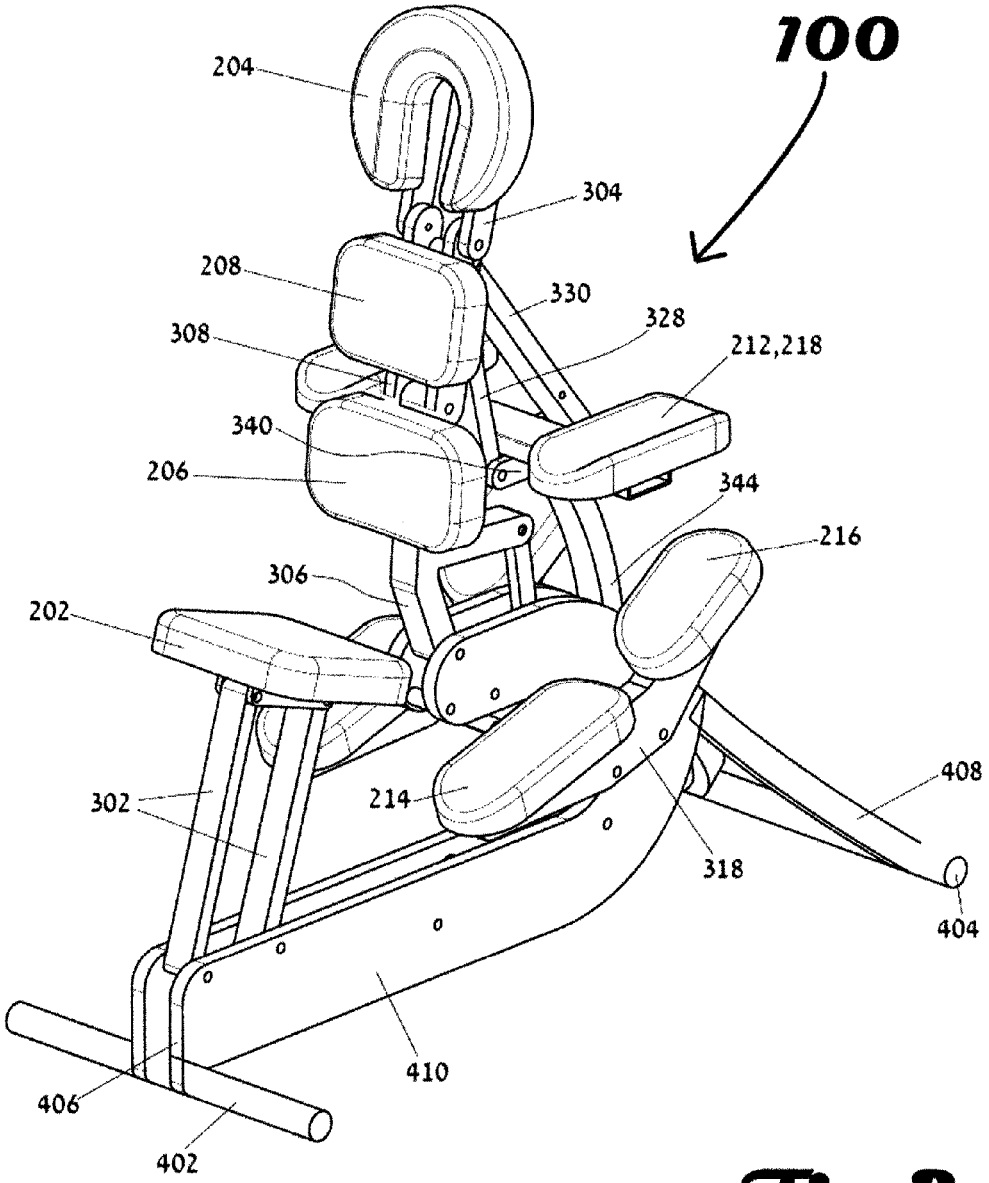
Figure 3:
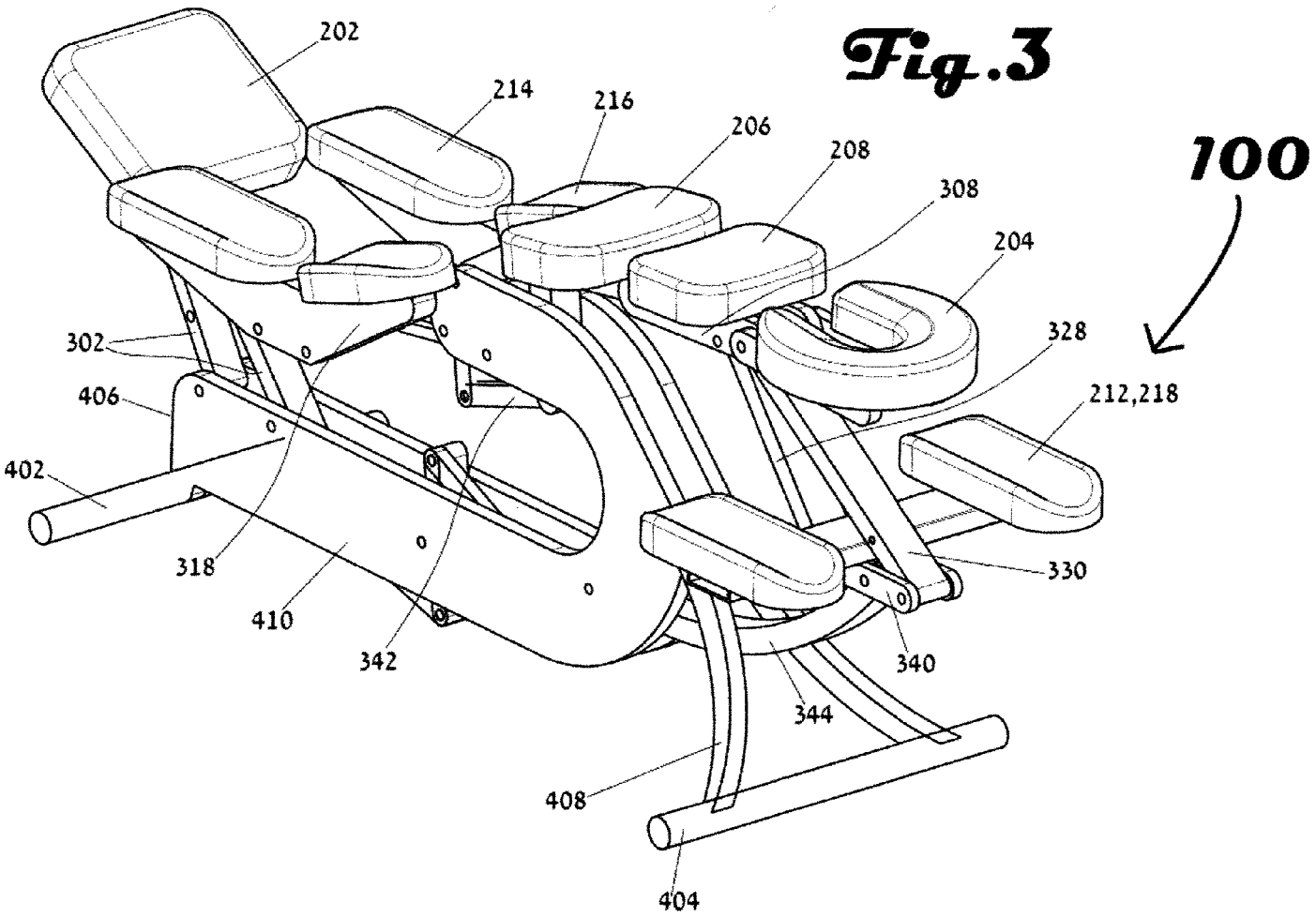
FIG. 3 is a schematic perspective illustration of the first articulated therapeutic apparatus of FIG. 2, where a prone position of the first articulated therapeutic apparatus may be seen.
Figure 4:
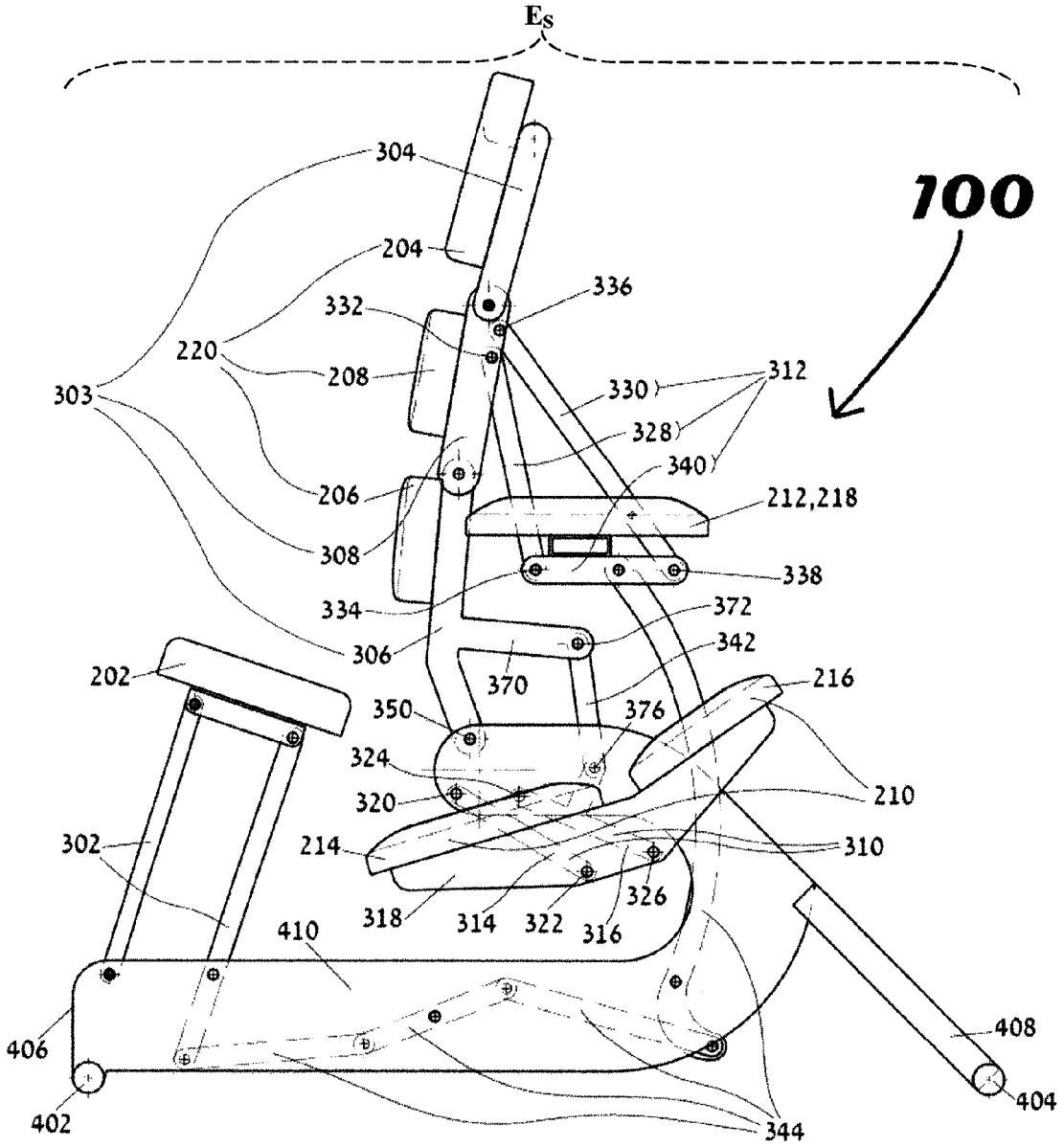
FIG. 4 is a right side elevation of the first articulating articulated therapeutic apparatus of FIG. 2, showing the articulated therapeutic apparatus in the seated position.
Figure 5:
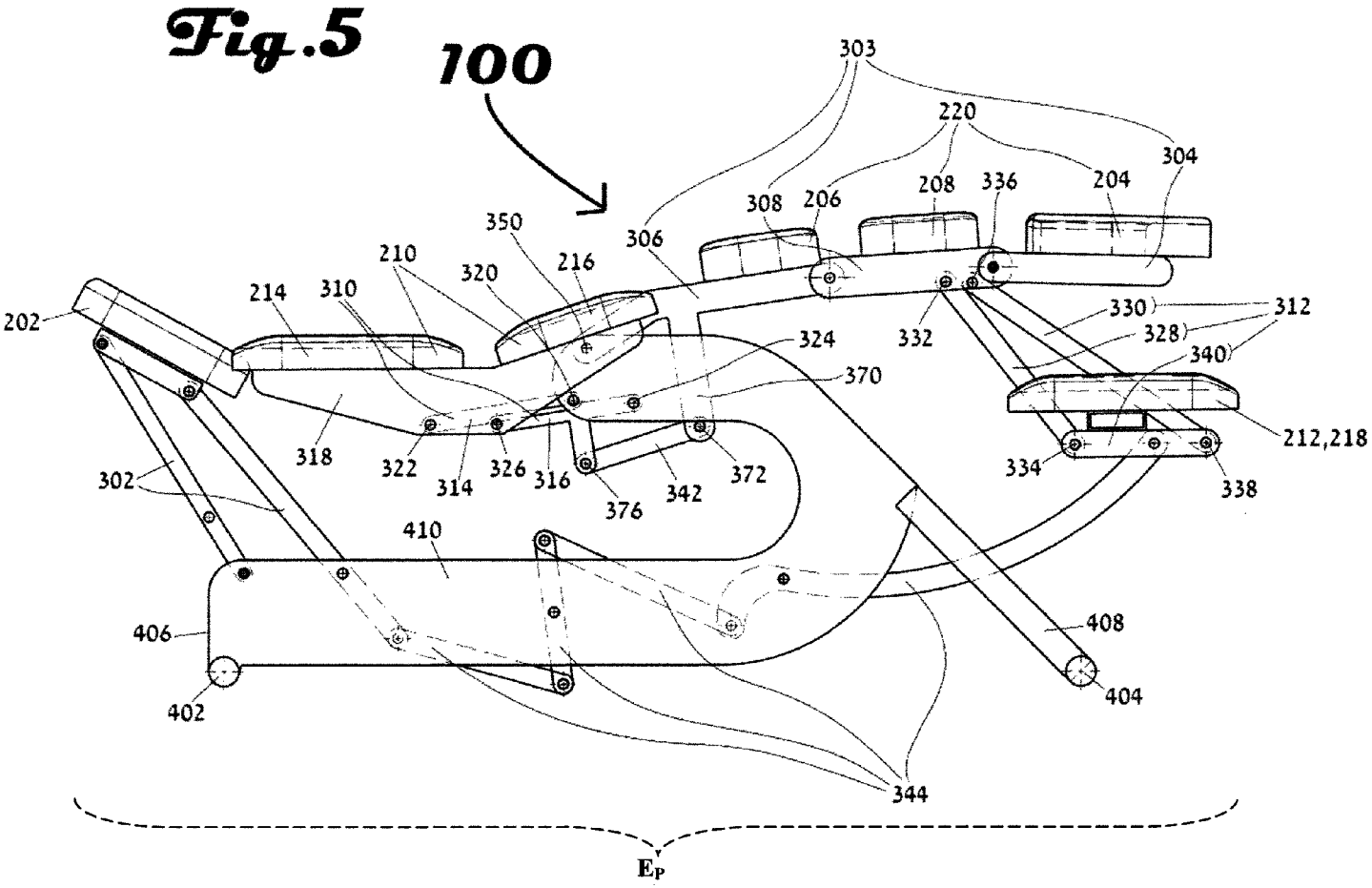
FIG. 5 is a schematic illustration of a right side elevation of the first articulated therapeutic apparatus of FIG. 2, showing the articulated therapeutic apparatus in the prone position

Referring to FIGS. 2 to 7 in more detail, reference numeral 100 generally represents an articulated therapeutic apparatus intended to support a patient in a seated position, and to assist in substantially passively transferring the patient from the seated position (best seen in FIG. 4) towards a prone position (best seen in FIG. 5). The articulated therapeutic apparatus 100 may generally comprise a multi-component, patient support system movably mountable on a multi-component articulated mechanism, which may, in turn, be connected to a base structure. The articulated mechanism, which will be discussed in greater details herein below, may consist of various links and/or mechanical, hydraulic and/or electrical, linear and/or rotating actuators, linked therebetween and/or to other components and/or parts of the therapeutic apparatus 100 via various hinges and/or connectors. For ease of illustration and/or description, such links and/or actuators and/or hinges and/or connectors may only be generally related to and/or schematically rendered as members and/or hinges, and should only be used or understood as an illustrative means to promote understanding of the present disclosure and accompanying claims.

All directional references (e.g., upper, lower, upward, downward, left, right, leftward, rightward, top, bottom, above, below, vertical, horizontal, clockwise, and counter-clockwise) are only used for identification purposes to aid the reader's understanding of the present disclosure, and may not create limitations, particularly as to the position, orientation, or use of the apparatus and/or method disclosed herein. Joinder references (e.g., attached, coupled, connected, hinged, and the like) are to be construed broadly and may include intermediate members between a connection of elements and relative movement between elements. As such, joinder references do not necessarily infer that two elements are directly connected and in fixed relation to each other.

The base structure comprises a base spine 410 which, in this particular embodiment, extends forwardly from a first base end 406 to a second base end 408. The base spine 410 may generally be arched and/or bent in elevation (attention is directed, in particular, to FIGS. 4 and 5, showing a right-side elevation view of the articulated therapeutic apparatus) in which a right side R and a left side L may be defined from a viewpoint of a patient supported on the patient support system of the articulated therapeutic apparatus 100 (see, in particular, FIG. 6). The base structure may further comprise first and second base supports 402, 404 secured and adjacent to the first and second base ends 406, 408, respectively, of the base spine 410, extending generally transversely to the base spine 410, and maintained in spaced and generally parallel relation therebetween.

However, other arrangements of feet and/or base supports may be utilized, without degrading from the spirit and scope of the present disclosure. Wheels and/or feet (not shown) may be secured to an underside of the first and second base supports 402, 404 of the base spine 410 and support the base spine 410 in spaced relation above a surface (not shown) upon which the base structure, and the entire articulated therapeutic apparatus 100, may be positioned. Various raising and/or lowering mechanisms (not shown) may additionally be disposed between the base spine 410 and the surface and/or between the base structure and the surface.

Although the generally arched and/or bent base spine 410 as shown in the figures was intended and/or designed and/or adapted for a particular arrangement, it may be foreseen that different, specific designs of the base structure may be made to agree with various configurations, so as to suit various possible embodiments of the articulated therapeutic apparatus 100, without detracting or limiting the scope of the present disclosure.

As can be best described keeping FIG. 5 in mind, the patient support system may comprise a movable seat 202 generally adjacent the first side support 402, and a movable torso rest 220 comprising a head rest 204 adjacent the second base support 404. An abdomen rest 206 (a part of the torso rest 220) disposed between the seat 202 and a forwardly disposed headrest 204, and optionally a separate chest rest 208 disposed between the head rest 204 and the abdomen rest 206. As shown in FIGS. 4 and 5, the torso rest 220 comprises the head, abdomen, and/or optional chest rests 204, 206, 208, which may comprise flat or generally anatomically-shaped rests. The head rest 204 may be designed in a horse-shoe like shape, as adjustable and/or fixed parallel-bars, as may be known in the art, however, other known or under-development rests could be employed without detracting from the spirit and scope of the present disclosure.

Figure 6:
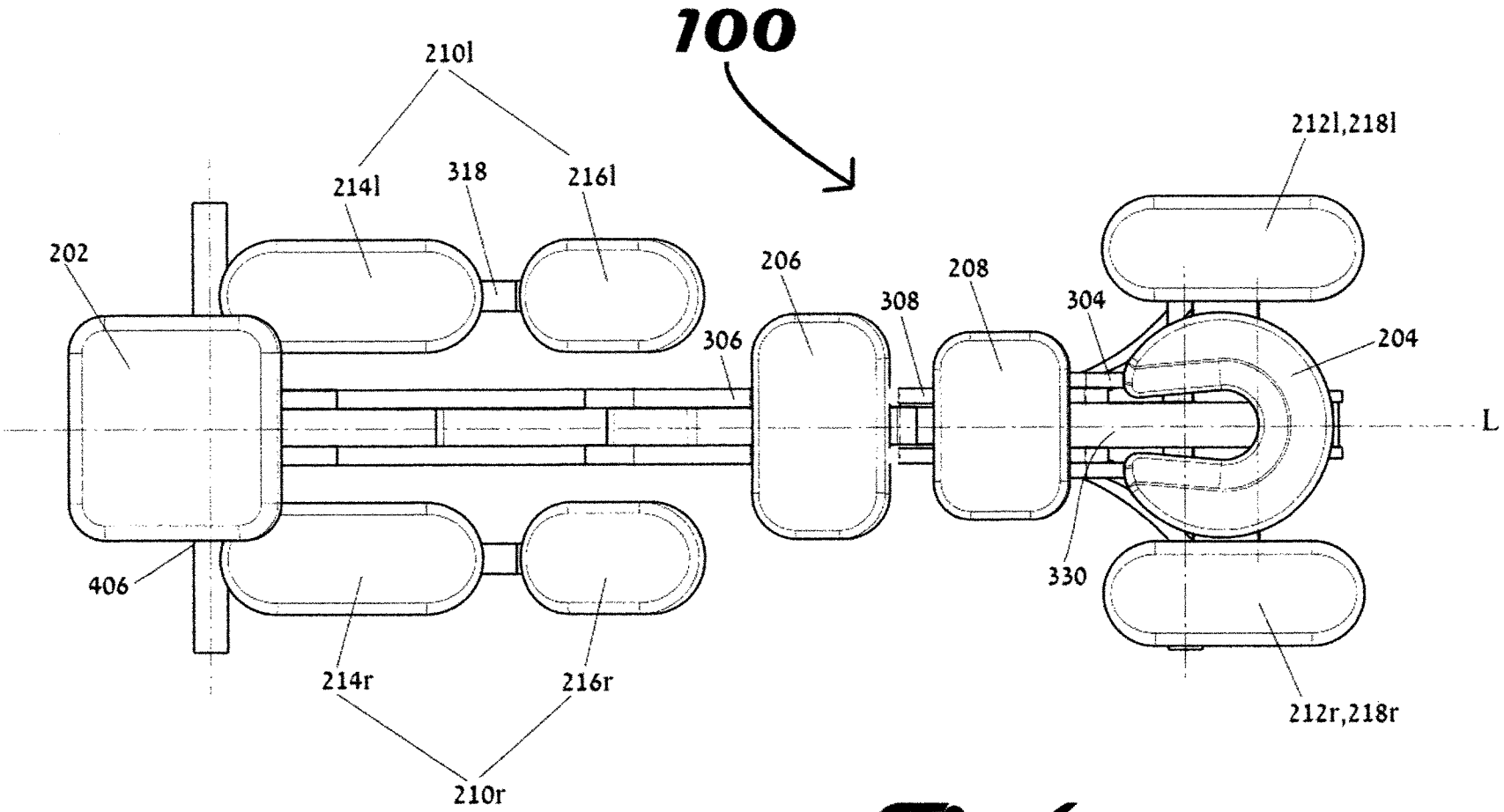
FIG. 6 is a schematic illustration showing a plan view of the first articulated therapeutic apparatus of FIG. 2 showing the articulated therapeutic apparatus in the prone position.
Figure 7:
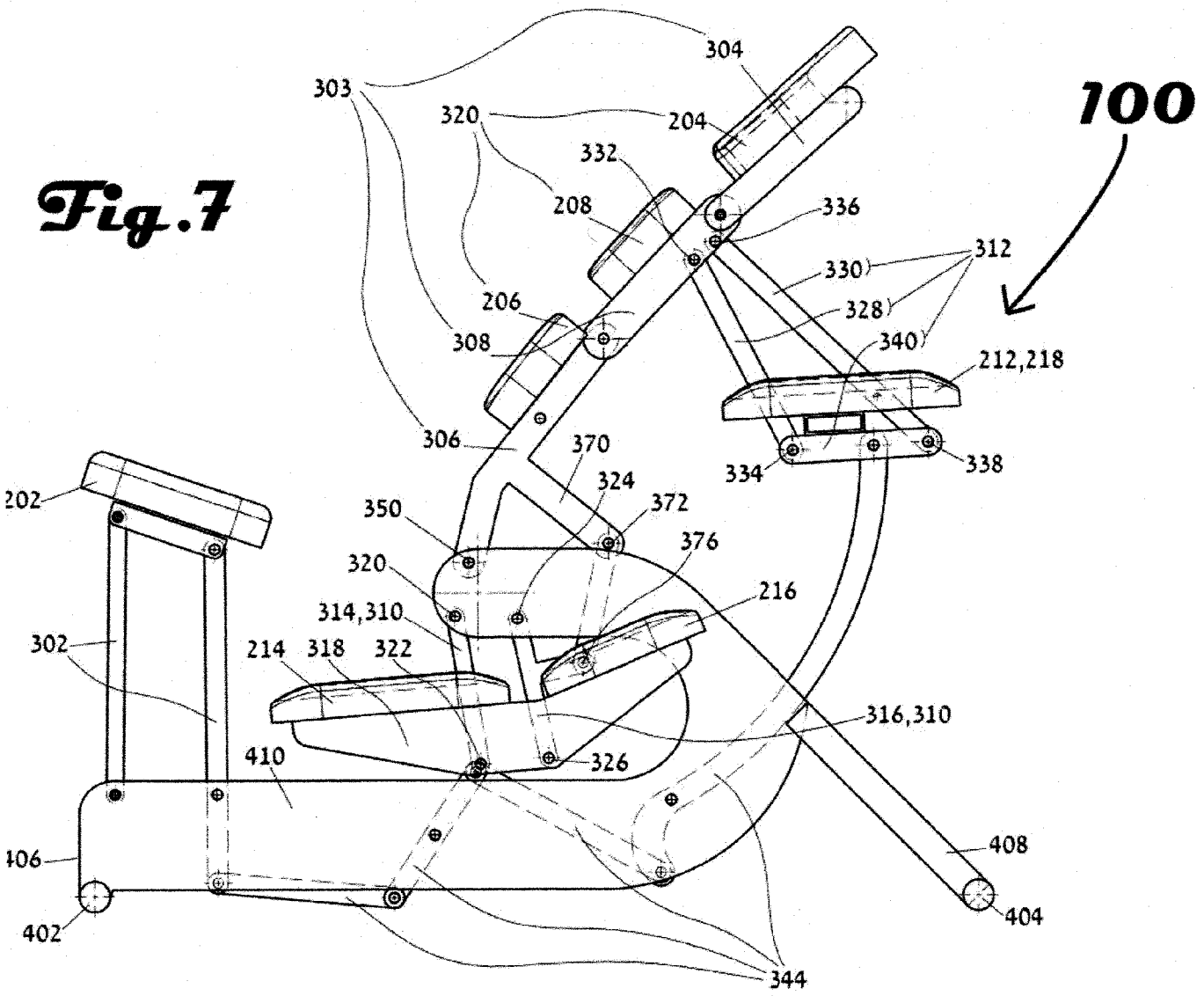
FIG. 7 is a schematic illustration showing a plan view of the first articulated therapeutic apparatus of FIG. 2 showing the articulated therapeutic apparatus in an intermediate, or interim, position.

As may be best seen in FIG. 6, when looking forward at the articulated therapeutic apparatus 100 in a direction away from the first base end 406, the articulated therapeutic apparatus 100 has a right side and a left side. Thus, the patient support system may further comprise two movable leg supports 210, i.e., one right leg support **210*r* and one left leg support 210*l* for each of the right and left legs of the patient, respectively, and two optional, movable arm supports 212, i.e., one right arm support 212*r* one right arm support 212*l* for each of the patient's right and left arms, respectively. In a second embodiment, shown in FIGS. 8 and 9, where no distinct, optional arm supports may be employed, the head, abdomen, and/or optional chest rests 204, 206, 208** may be additionally used as arm rests, as may be common or known in the art.

Each of the right and left leg supports **210*r*, 210*l* may comprise a movable shin support 214*r*, 214*l*. Potentially, each of the right and left leg supports 210*r*, 210*l* may further comprise an optional, movable right or left thigh support 216*r*, 216*l*, capable of moving either independently or in concert with its respective right or left shin support 214. Similarly, each of the optional right and left arm supports 212*r*, 212*l* may comprise a movable lower arm support 218*r*, 218*l*. Potentially, each of the optional right and left arm supports 212*r*, 212*l* may further comprise a movable upper arm support (not shown) able to move either independently or in concert with its respective right or left lower arm support 218**.

Any of the head, abdomen, and/or optional chest rests 204, 206, 208 may be optionally and/or selectively raised and/or lowered with respect to any member of the articulated mechanism either actively and/or passively, with which it may be associated (as may be further illustrated and/or exemplified herein below) for better adaptability to different persons' anatomy and/or for use in certain manipulative procedures generally known as "drop section" techniques (see, for example, "Technique systems in chiropractic", by Robert Cooperstein & Brian J. Gleberzon, Chapter 29 titled "Thompson Technique" or "Thompson Terminal Point Technique", *Churchill Livingstone,* 2004). Similarly, each of the head, abdomen, and/or optional chest rests 204, 206, 208 may be optionally movable longitudinally and/or laterally and/or optionally be rotatable about a longitudinal axis L (best seen in FIG. 6), to facilitate adaptability of the articulated therapeutic apparatus 100 to better accommodate different patients having varying patient's dimensions and/or proportions, and/or to facilitate various therapeutic operations, and/or to compensate for various posture changes of the patient.

The articulated mechanism may interlink the base structure and the patient support system, and may comprise a seat mechanism 302 adjacent the first end 406 of the base spine 410 connecting the seat 202 to the base spine 410. A leg support mechanism 310, disposed forwardly relative to the seat mechanism 302, may interlink the leg supports 210 and the base structure. Since there may exist independent right and left leg supports 210*r*, 210*l*, there may be provided independent right and left leg support mechanisms 310.

In a particular embodiment schematically illustrated in FIGS. 2 to 7, and discussed herein, the leg support mechanism 310 (as better seen in FIGS. 4 and 5) may comprise a rearward leg member 314 and a forward leg member 316. The rearward leg member 314 extends between a base rear end 320 connected to the base structure and a rearward leg end 322. Similarly, the forward leg member 316 extends between a base forward end 324 connected to the base structure and a forward leg end 326. An intermediate leg member 318 may be connected to, and may extend between and beyond, the rearward leg end 322 and the forward leg end 326. The intermediate leg member 318 supports the leg support 210.

The articulated mechanism may further comprise an articulated torso mechanism 303 comprising an abdomen member 306, an optional chest member 308, and a head member 304, all may be individually adjustable relative to each other and/or to the base structure. The articulated torso mechanism 303 may be hinged about a pelvic hinge 350 connecting the articulated torso mechanism 303 to the base structure. The abdomen member 306 extends away from the pelvic hinge 350 towards the head member 304. Possibly, if the optional, separate chest rest 208 is employed, an optional chest member 308 may extend between the abdomen member 306 and the head member 304. The abdomen, head, and optional chest member 306, 304, 308 may be hinged to each other, to facilitate relative movement between each two members either manually or mechanically, electronically, hydraulically and/or pneumatically.

The torso mechanism 303 may further comprise a lug 370 extending generally transversely to the abdomen member 306 away from the abdomen rest 206, which may be mounted on the abdomen member 306. The lug 370 may be rigidly connected with the abdomen member 306 and may be cantilevered, and extend away, therefrom, to a first linkage hinge 372. A leg linkage 342, extending between the first linkage hinge 372 and a second linkage hinge 376 may link the lug 370 with the leg support system 310, for a non-binding, non-limiting example, to the forward leg member 316 of the leg support mechanism 310. The leg linkage 342 may be realized as purely mechanical member and/or hydraulic and/or pneumatic and/or electric actuator.

To realize a coordinated and/or facilitate relative movement between the torso mechanism 303 (which, in turn, may be associated, and move in a coordinated manner, with the head, abdomen, and/or optional chest rests 204, 206, 208) and the leg support mechanism 310, the leg linkage 342 may link the torso mechanism 303 and its associated lug 370 with the leg mechanism 310. When the torso mechanism 303 moves from a substantially upright posture in a seated position (as may be seen, for example, in FIG. 4) towards a substantially extended posture in a prone position (as may be seen, for example, in FIG. 5), the leg support system 310 may move away from a substantially folded posture in the seated position (as may be seen, for example, in FIG. 4) towards a substantially extended posture in the prone position (as may be seen, for example, in FIG. 5) in a coordinated and/or simultaneous manner. This may be effected either unassisted, i.e., in a pure mechanical manner, or assisted (hydraulically, pneumatically, and/or electrically) and/or any combination thereof.

In the context of the present disclosure, "coordinated" means that a movement in one sub-system results in a corresponding movement in another sub-system. Further, "simultaneous" means that the two related sub-systems occurs in the same time. During such movement, the seat mechanism, torso mechanism and leg mechanism may move continuously between the two extremities of the movement, i.e., to any position between a fully seated position and a fully prone position.

When in the fully prone position, the articulated therapeutic apparatus 100 may have a prone extent $E_P$ (shown on FIG. 5) measured parallel to the surface upon which the articulated therapeutic apparatus 100 may rest. Similarly, when in the fully seated position, the articulated therapeutic apparatus 100 may have a seated extent $E_S$ (shown on FIG. 4) measured parallel to the surface upon which the articulated therapeutic apparatus 100 may rest. The prone extent $E_P$ is larger than the seated extent $E_S$.

In the particular embodiment schematically illustrated in FIGS. 2 to 7, and discussed herein, the optional arm support mechanism 312 may be hinged to the abdomen member 306 or to the optional chest member 308 adjacent the head member 304. The optional arm support mechanism 312 may comprise a rearward arm member 328 and a forward arm member 330. The rearward arm member 328 extends between a rearward mechanism end 332 connected to the torso mechanism 303, and a rearward link end 334. Similarly, the forward arm member 330 extends between a forward mechanism end 336 connected to the torso mechanism 303 and a forward link end 338. An intermediate arm member 340 may be connected to, and may extend between, the rearward link end 334 and the forward link end 338. Each of the intermediate arm members 340 supports its respective arm support 212. Each of the arm supports 212 may be movable laterally, longitudinally, and/or rotationally relative to the intermediate arm member 340. Additionally, each optional arm support mechanism 312 may rotate and/or move laterally about the longitudinal axis L. Further, each optional intermediate arm member 340 may rotate in a generally horizontal plane.

The optional chest rest 208 and the abdomen rest 206 and head rest 204 may be independently movable relative to each other and/or relative to the torso mechanism 303 and/or to each of its abdomen member 306, optional chest member 308, and head member 304. The optional chest rest 208 and the abdomen rest 206 and the head rest 204 may be coupled along and/or about one or more degrees of freedom of movement, linked therebetween and/or integrally connected. Each potentially movable rest may be locked, or prevented from freely moving, either by the therapist and/or automatically.

In the extended posture, the optional arm supports 212 may move forwardly relative to the pelvic hinge 350. The intermediate arm member 340 of the optional arm support mechanism 312 may be coupled to, and/or linked with, the seat mechanism 302 by a second linkage system 344. Generally, the second linkage system 344 may be effected and/or realized either mechanically, hydraulically, pneumatically and/or electrically through a system comprising levers and/or links and/or hinges and/or actuators and/or any combination thereof.

The second linkage system 344 may transfer and/or coordinate motion between the intermediate arm member 340 and thus the optional arm support mechanism 312, and the seat mechanism 302, so that when the intermediate arm member 340 (which, in turn, is associated, and move, with the optional arm support mechanism 312) moves from the substantially upright posture in the seated position (as may be seen, for example, in FIG. 4) towards the substantially extended posture in the prone position (as may be seen, for example, in FIG. 5) the seat mechanism 302 may move away from a substantially folded posture in the seated position (as may be seen, for example, in FIG. 4) towards a substantially extended posture in the prone position (as may be seen, for example, in FIG. 5) in a coordinated manner. This motion too may be effected either unassisted, i.e., in a pure mechanical manner, or assisted (either hydraulically, pneumatically, and/or electrically) and/or any combination thereof. From the seated position, the seat 202 may move first generally towards, and then generally away from, the pelvic hinge 350.

Figure 8:
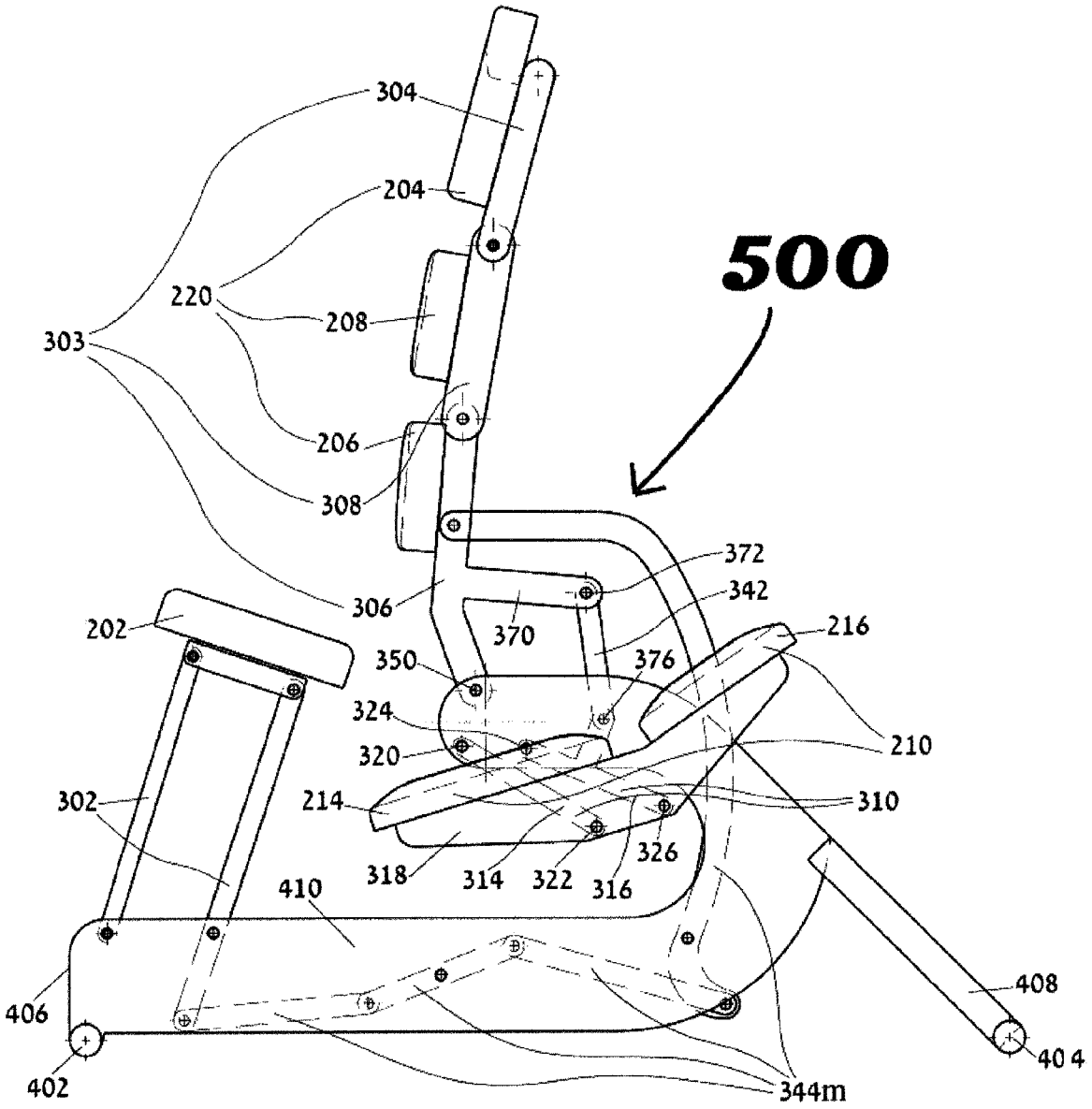
FIG. 8 is a schematic illustration showing a right side elevation view of a modified, exemplary, neither exhaustive nor limiting embodiment of the articulated therapeutic apparatus shown in FIG. 2, in which the modified therapeutic apparatus may be seen in a seated position.
Figure 9:
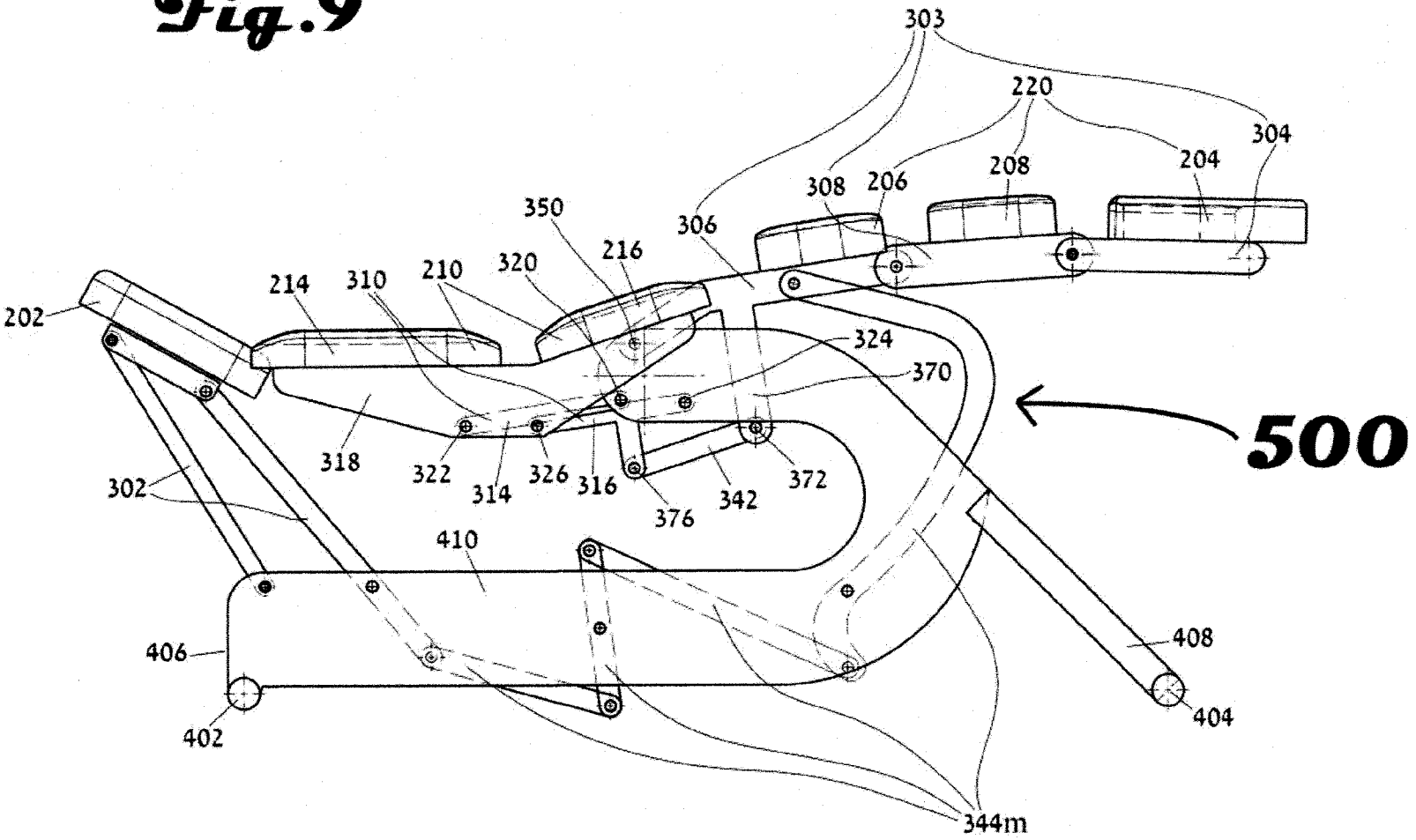
FIG. 9 is a schematic illustration showing a right side elevation view of the modified therapeutic apparatus shown in FIG. 8, in which the modified therapeutic apparatus may be seen in a prone position.

Attention is presently drawn to FIGS. 8 and 9. In a modified therapeutic apparatus embodiment 500, where no distinct, optional arm supports are employed, no arm support mechanism may be used. Thus, in the modified embodiment, the torso mechanism 303 may be coupled to, and/or linked with, the seat mechanism 302 by a modified second linkage system 344*m* to effect a coordinated movement of the seat mechanism 302 with the torso mechanism 303.

When practicing and/or administering therapy and/or diagnosis, the patient (not shown) may first be positioned on any of articulated and/or modified therapeutic apparatus 100, 500 facing the torso rest 220. Subsequently, the patient may be positioned, or asked to sit, with patient's buttocks resting on the movable seat 202, and with his or her legs slightly bent. Shins of the patient's legs may lean against the shin supports 214, while the patient's torso may lean on, or be supported by, the torso rest 220. The patient's arms may rest along the patient's torso, supported on, or by, the torso rest 220. Alternatively, the patient's arms may be supported be the optional arm supports 212. This will be referred to herein as a seated position.

After the patient is positioned on the articulated and/or modified therapeutic apparatus 100, 500, patient's posture may be passively modified from the seated position (as may be best seen in FIG. 4), through an interim, or transitional, position (see, as an illustrative example only, FIG. 7), and towards a prone position (may be exemplarily illustrated in FIG. 5). As the patient is transferred from the seated position, the torso rest 220 may be leaned, or tilted, away from the seated position in which the torso rest 220 may be generally transverse to the surface (not shown) upon which the base structure and the entire articulated therapeutic apparatus 100, may be positioned, through the interim position, and towards a prone position in which the torso rest 220 may be approximately parallel to the surface (not shown) upon which the base structure, and the entire articulated and/or modified therapeutic apparatus 100, 500, may be positioned.

During transition, the torso rest 220 moves from the seated position towards the prone position. Coordinated, and simultaneously, the seat 202 may move towards the interim position (may be illustrated in FIG. 7) and subsequently away from the pelvic hinge 350 towards the prone position (may be best seen in FIG. 5). Additionally, optionally provided arm supports 212 may be employed, so that the optional arm supports 212 may move mainly and/or generally, but not limited to, forwardly from the seated position, towards the prone position. Similarly, during the transition from the seated position towards the prone position, the leg supports 210 may move in a coordinated and/or simultaneous movement with the torso rest 220, mainly and/or generally, but not limited to, rearwardly, to move the patient's shins and optionally the patient's thighs towards the prone position. Generally, during transition from the seated position towards the prone position, the patient's weight may be transferred gradually from the patient's buttocks and shins (which carry most of the patient's weight in the seated position) to the patient's shins, thighs, pelvis and torso (in the prone position). This may generally be carried-out without the patient having to exert her- or himself.

As the torso rest 220 (along with the torso mechanism 303 to which the torso rest 220 may be connected) tilts and/or reclines about the pelvic hinge 350 forwardly and downwardly away from the seated position towards the prone position, the patient's torso may be tilted forwardly until it may lie prone on the torso rest 220. Simultaneously, and coordinated with the tilting and/or reclining motion of the torso rest 220 and the torso mechanism 303, the leg supports 210 may be tilted mainly, but not limited to, backwards, so as to bring patient's shins towards the extended posture, thus transitioning the patient's posture to the prone position.

Several other possible and/or exemplary embodiments, versions or modifications, neither exhaustive nor limiting in any manner or form, of an articulated therapeutic apparatus, may be considered according to the present disclosure. It is to be understood that such exemplary and/or possible embodiments, versions or modifications are merely illustrative of and should not be taken as to hint nor indicate any restriction on the broad present disclosure, and that the present disclosure may not be limited to the specific constructions and arrangements shown and described, since various other modifications and/or adaptations may occur to those of ordinary skill in the art.

Figure 10:
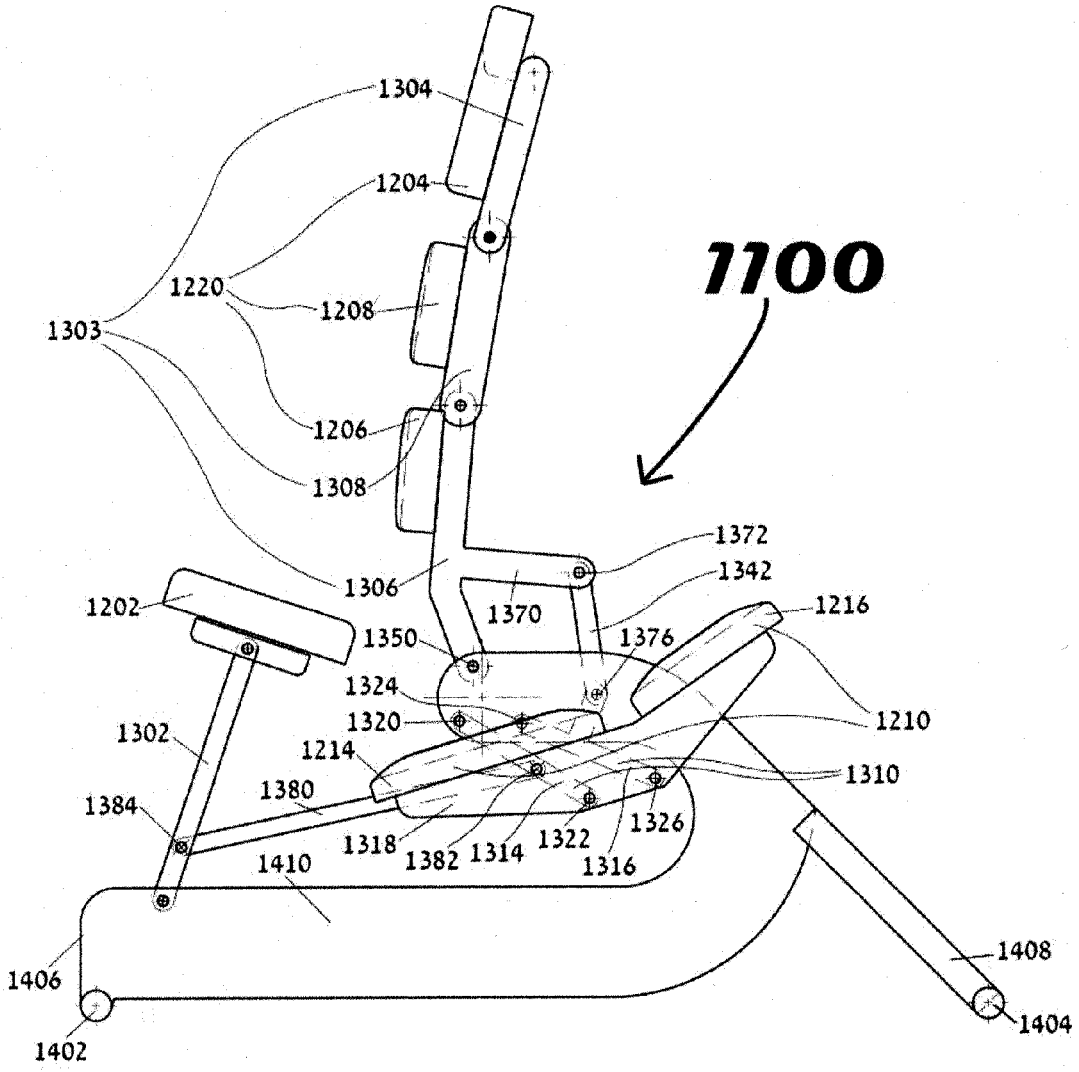
FIG. 10 is a schematic illustration showing a right side elevation view of a second of several possible, exemplary, neither exhaustive nor limiting embodiments, of a modified therapeutic apparatus according to the present disclosure, in which the second therapeutic apparatus may be seen in a seated position.
Figure 11:
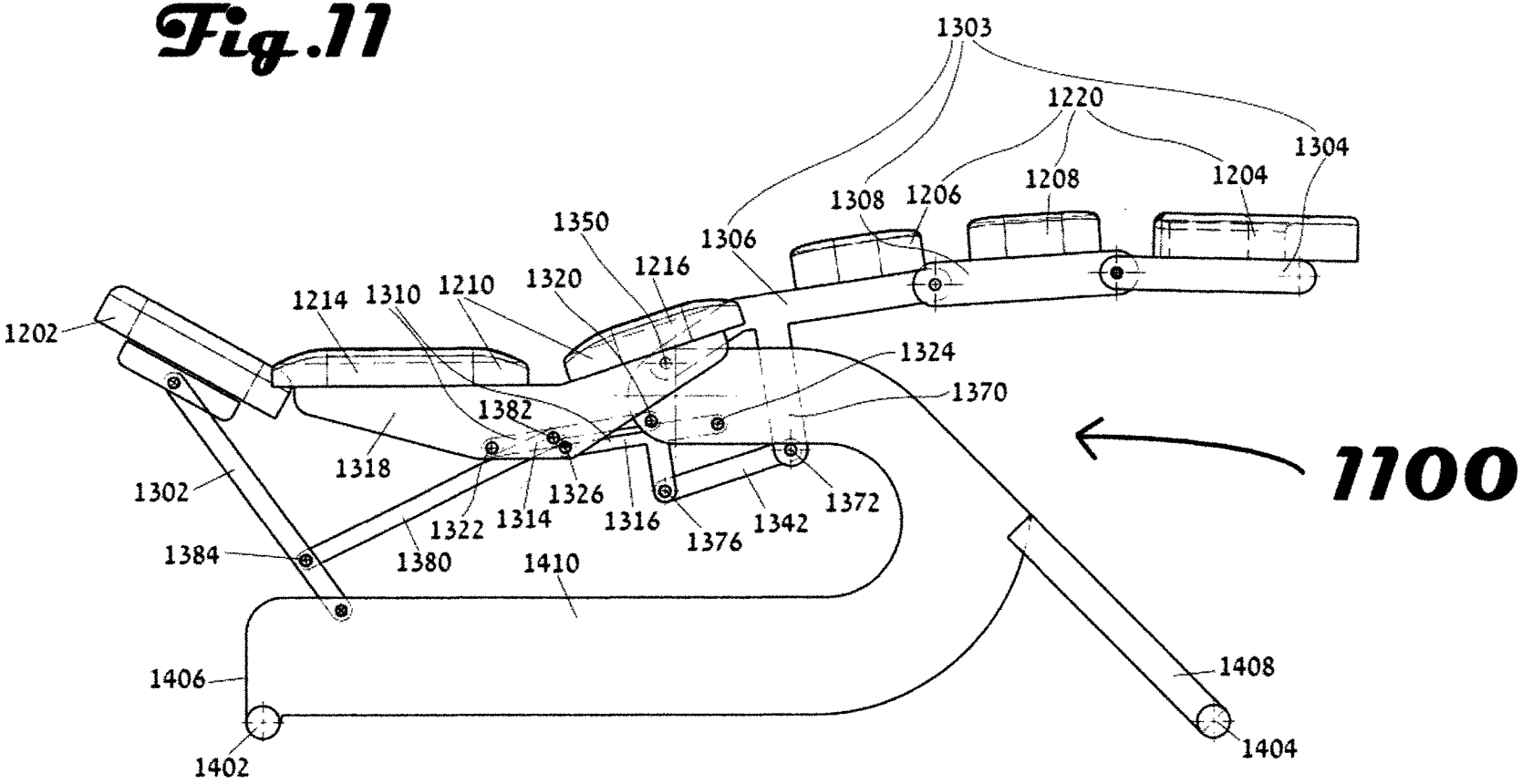
FIG. 11 is a schematic illustration showing a right side elevation view of the second modified therapeutic apparatus shown in FIG. 10, in which the second therapeutic apparatus may be seen in a prone position.

Attention is presently drawn to FIGS. 10 and 11, schematically illustrating a second of several possible; exemplary, neither exhaustive nor limiting embodiments, of a modified therapeutic apparatus 1100 according to the present disclosure, in a seated position, and in a prone position, respectively. The second modified therapeutic apparatus is similar to the modified embodiment of the articulated therapeutic apparatus 100 having no optional arm rests. Similar features for the second articulated therapeutic apparatus 1100 have been given reference numerals that are the reference numerals used for the articulated therapeutic apparatus 100 increased by 1000.

Intended to assist in coordinating movements of a torso mechanism 1303 with a leg support system 1310 and with a seat mechanism 1302, a coordinating linkage 1380 may extend between a forward coordinating hinge 1382 linked to the leg support system 1310, optionally, as an illustrative-only, non-limiting example, to a rearward link member 1314 and a rearward coordinating hinge 1384 linked with the seat mechanism 1302.

Figure 12:
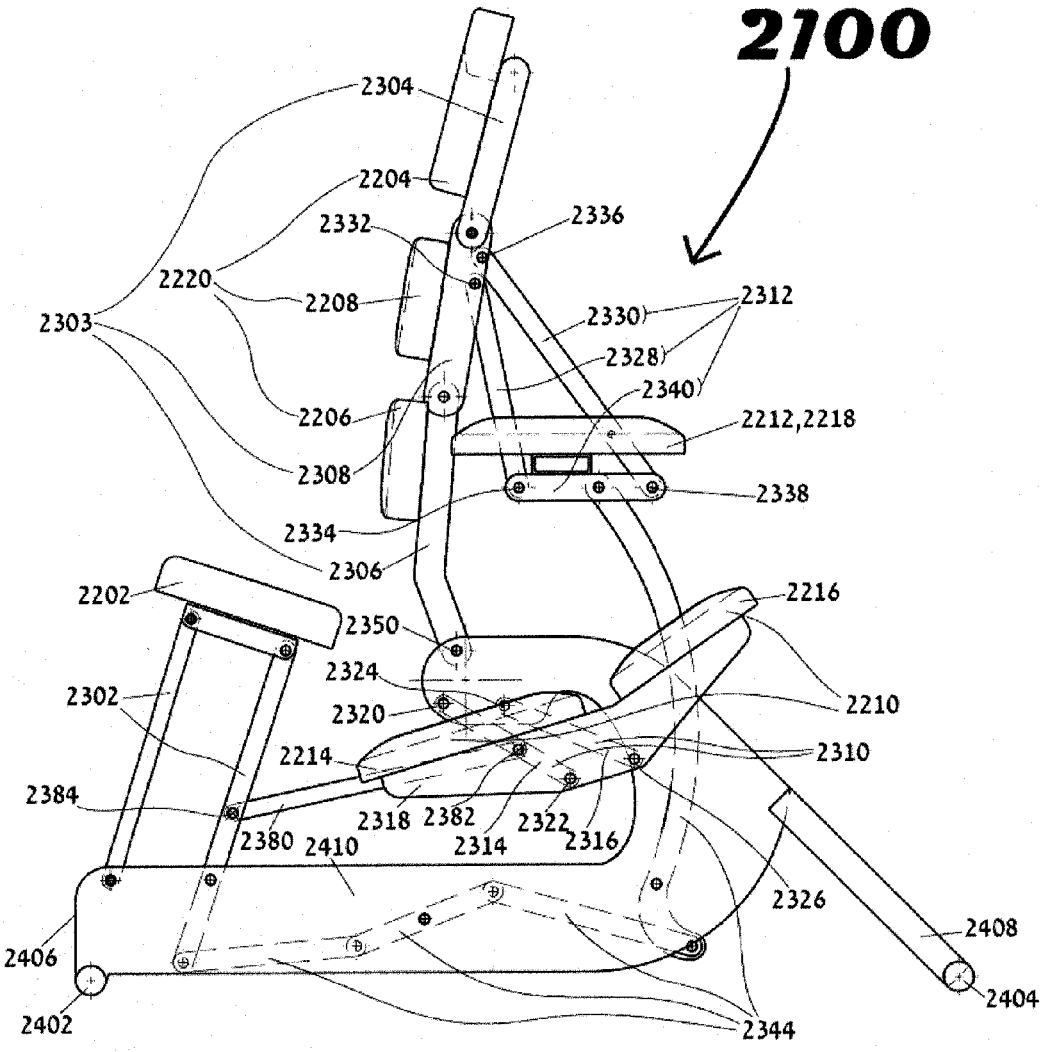
FIG. 12 is a schematic illustration showing a right side elevation view of a third of several possible, exemplary, neither exhaustive nor limiting embodiments, of an articulated therapeutic apparatus according to the present disclosure, in which the third therapeutic apparatus may be seen in a seated position.
Figure 13:
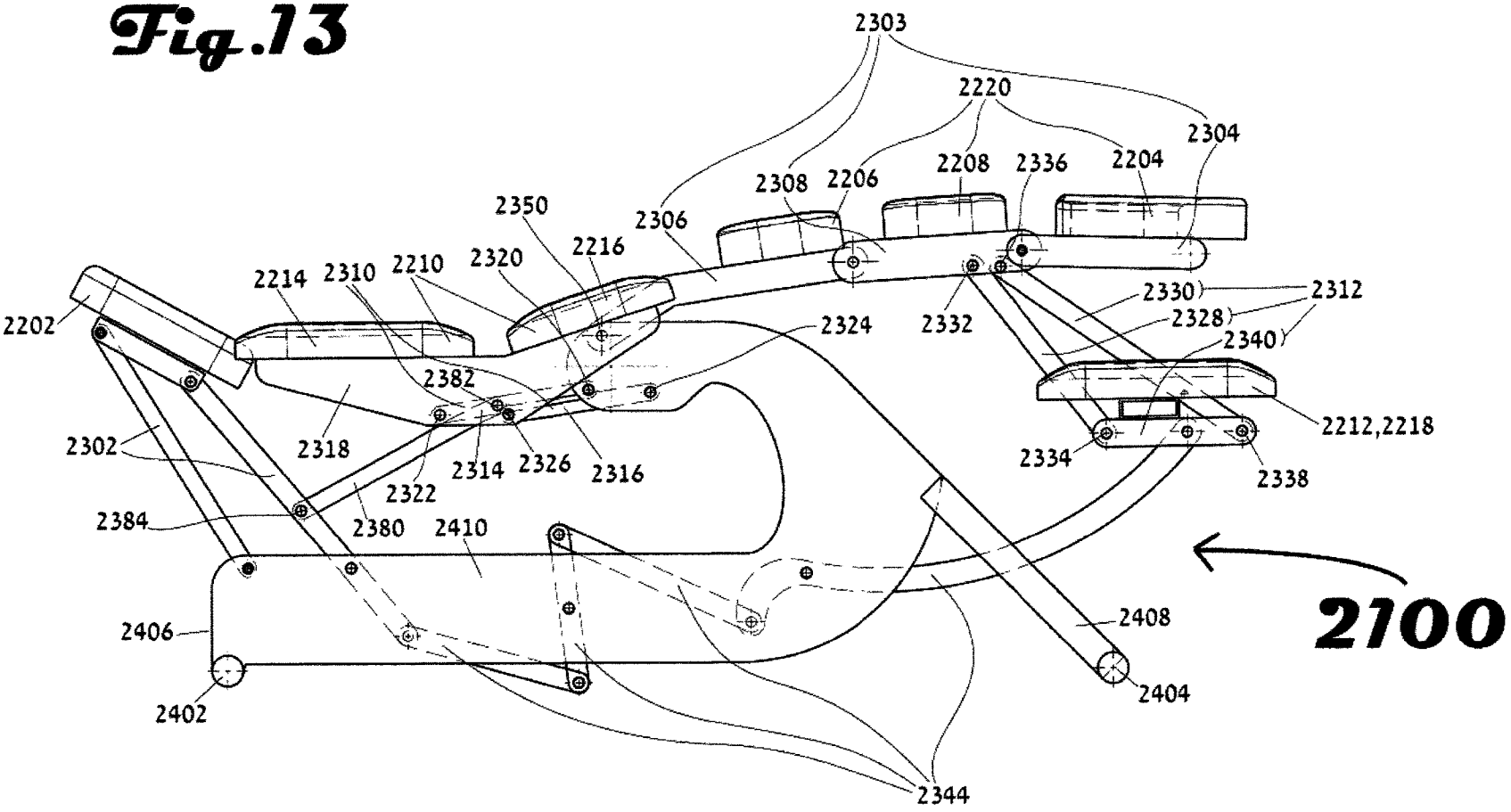
FIG. 13 is a schematic illustration showing a right side elevation view of the third articulated therapeutic apparatus shown in FIG. 12, in which the third therapeutic apparatus may be seen in a prone position.

Attention is presently drawn to FIGS. 12 and 13, schematically illustrating a third of several possible, exemplary, but neither exhaustive nor limiting embodiments of an articulated therapeutic apparatus 2100 according to the present disclosure, in a seated position, and in a prone position, respectively. Similar features for the third articulated therapeutic apparatus 2100 have been given reference numerals that are the reference numerals used for the articulated therapeutic apparatus 100 increased by 2000.

Intended to assist in coordinating movements of a torso mechanism 2303 with a leg support system 2310 and with a seat mechanism 2302, a coordinating linkage 2380 may extend between a forward coordinating hinge 2382 linked to the leg support system 2310, linked, as an illustrative-only, non-limiting example, to a rearward link member 2314 and a rearward coordinating hinge 2384 linked with the seat mechanism 2302.

As the third articulated therapeutic apparatus 2100 transitions from a seated position (FIG. 12) to a prone position (FIG. 13), the torso mechanism 2303 pushes an arm support mechanism 2312 which is linked to the torso mechanism 2303. A second linkage system 2344 links the arm support mechanism 2312 and the seat mechanism 2302. The seat mechanism 2302 is moved so that a seat 2202 moves generally rearwardly from the seated position to the prone position.

As the seat mechanism 2302 moves, it pulls the coordinating linkage 2380 and the leg support system 2310 connected therewith.

Figure 14:
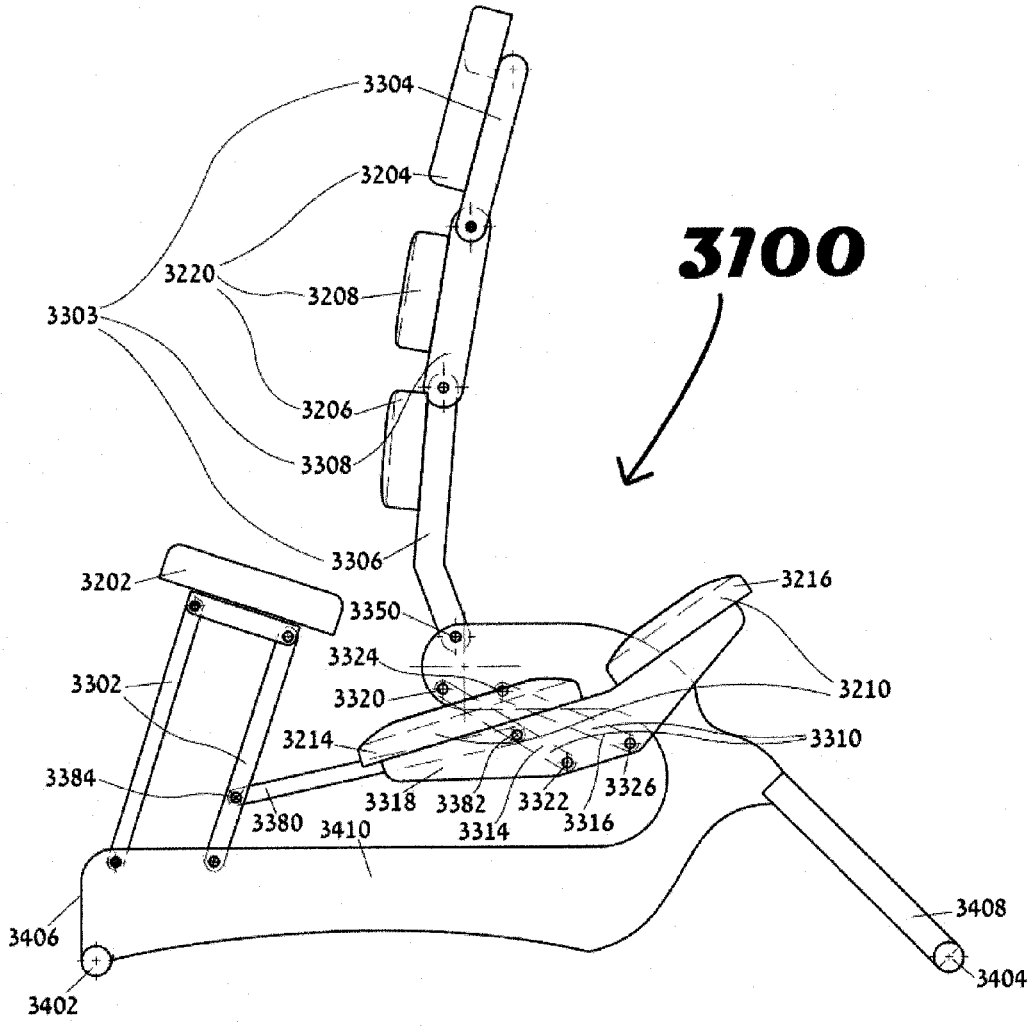
FIG. 14 is a schematic illustration showing a right side elevation view of a fourth of several possible, exemplary, neither exhaustive nor limiting embodiments, of a modified therapeutic apparatus according to the present disclosure, in which the fourth therapeutic apparatus may be seen in a seated position.
Figure 15:
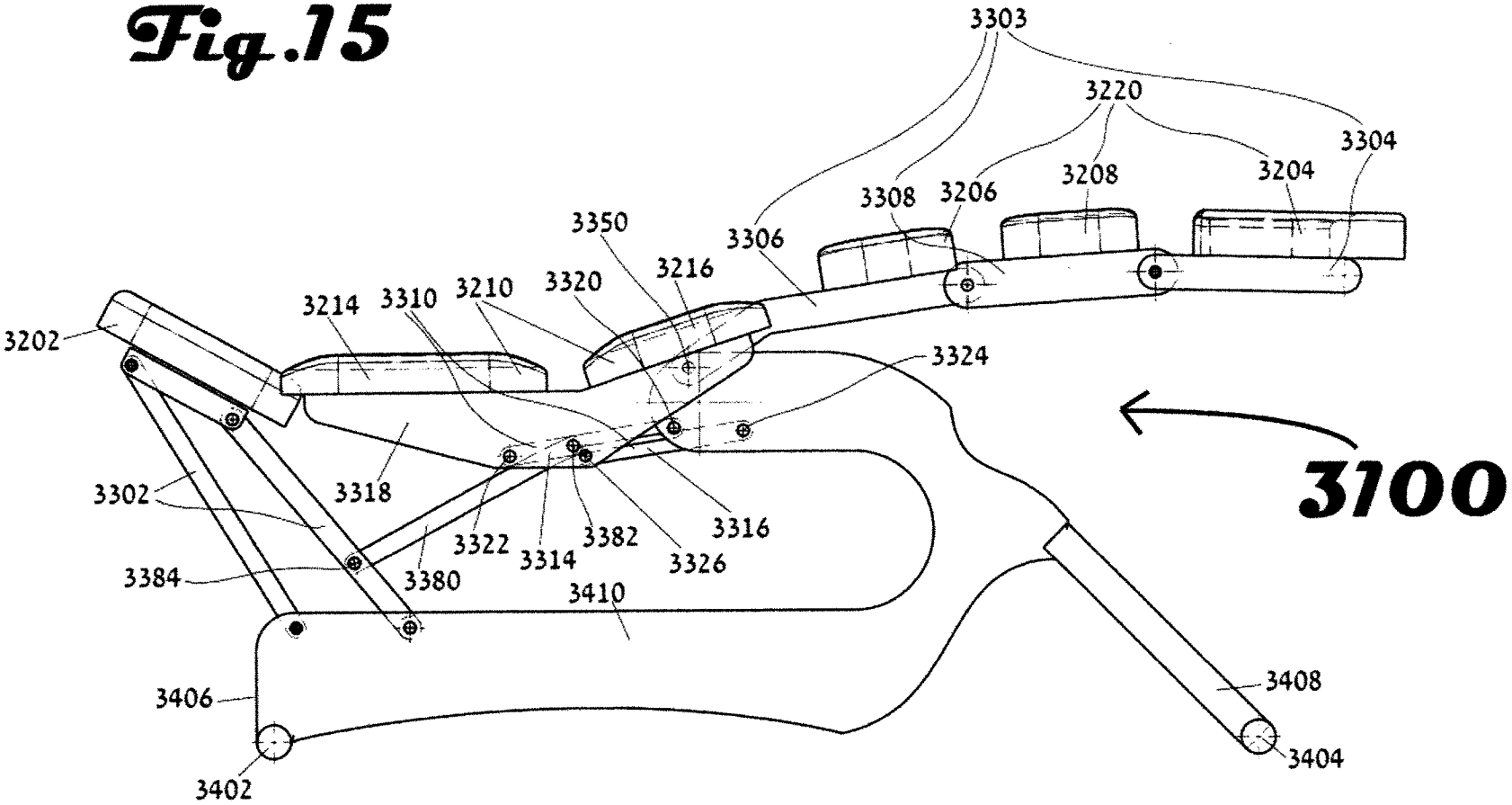
FIG. 15 is a schematic illustration showing a right side elevation view of the fourth modified therapeutic apparatus shown in FIG. 14, in which the fourth therapeutic apparatus may be seen in a prone position.

Attention is presently drawn to FIGS. 14 and 15, schematically illustrating a fourth of several possible, exemplary, neither exhaustive nor limiting embodiments of a modified therapeutic apparatus 3100 according to the present disclosure, in a seated position, and in a prone position, respectively. Similar features for the fourth modified therapeutic apparatus 3100 have been given reference numerals that are the reference numerals used for the articulated therapeutic apparatus 100 increased by 3000.

Intended to assist in coordinating movements of a torso mechanism 3303 with a leg support system 3310 and with a seat mechanism 3302, a coordinating linkage 3380 may extend between, and hingedly join, the leg support system 3310 and with the seat mechanism 3302. The coordinating linkage 3380 may extend between a forward coordinating hinge 3382 linked to the leg support system 3310, as an illustrative-only, non-limiting example, to a rearward link member 3314 and a rearward coordinating hinge 3384 linked with the seat mechanism 3302.

Movement of a torso mechanism 3303 and its related abdomen rest 3204, head rest 3206, and optional chest rest 3208 may be effected by a torso actuator (not shown) which may generally be connected between a base spine 3410 and the torso mechanism 3303, while motion of the leg support system 3310 and/or the coordinated seat mechanism 3302 may be effected by either a seat actuator (not shown) which may generally be connected between the base spine 3410 and the seat mechanism 3302, or, alternatively, a leg actuator (not shown) which may generally be connected between the base spine 3410 and the leg support system 3310 may effect the motion of the leg support system 3310 and/or the coordinated seat mechanism 3302. Yet another option is to effect the motion of the leg support system 3310 and/or the coordinated seat mechanism 3302 by a coordinating actuator (not shown) generally disposed between the coordinating linkage 3380 and the base spine 3410. If employed, such actuators may be of any known or discovered type.

Figure 16:
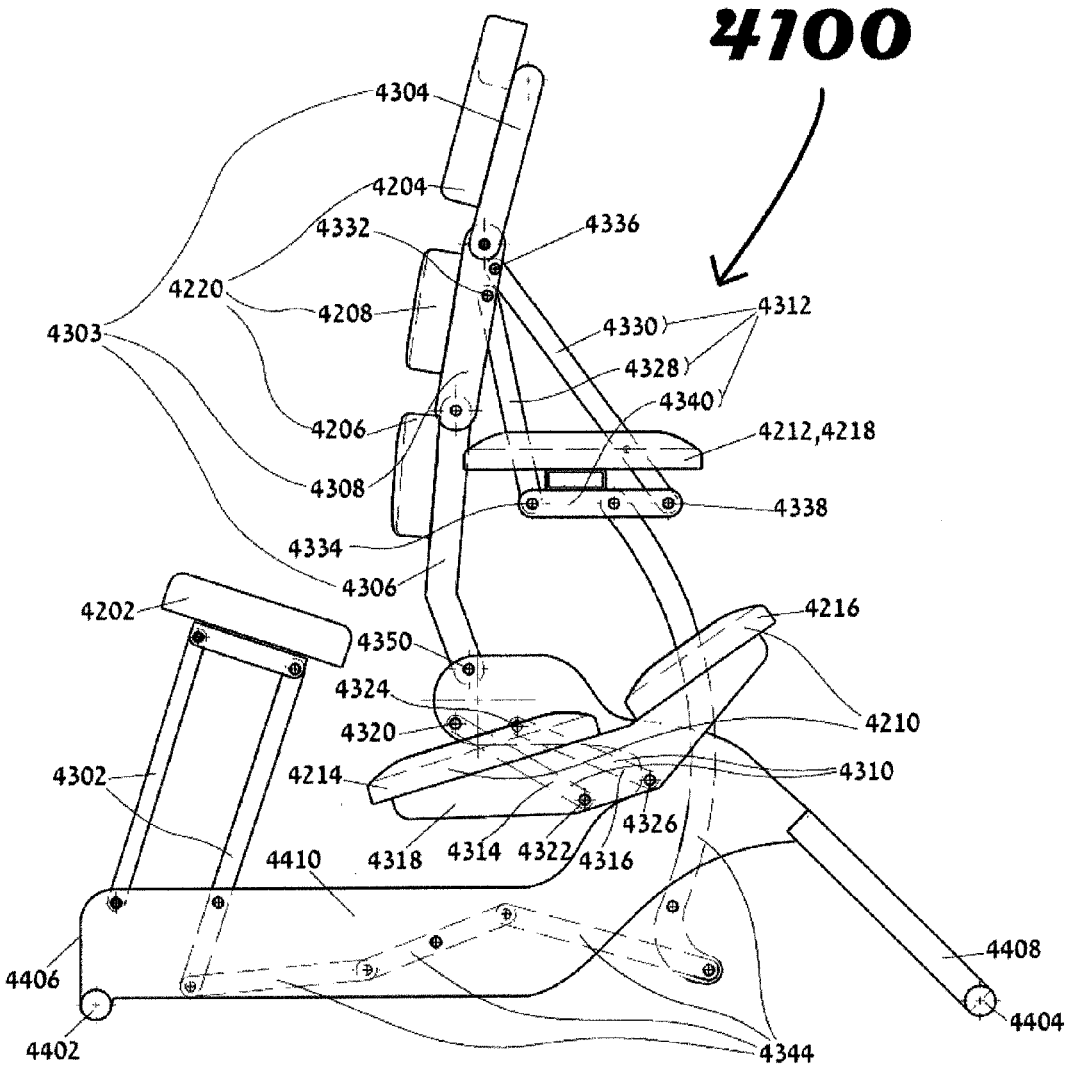
FIG. 16 is a schematic illustration showing a right side elevation view of a fifth of several possible, exemplary, neither exhaustive nor limiting embodiments, of an articulated therapeutic apparatus according to the present disclosure, in which the fifth therapeutic apparatus may be seen in a seated position.
Figure 17:
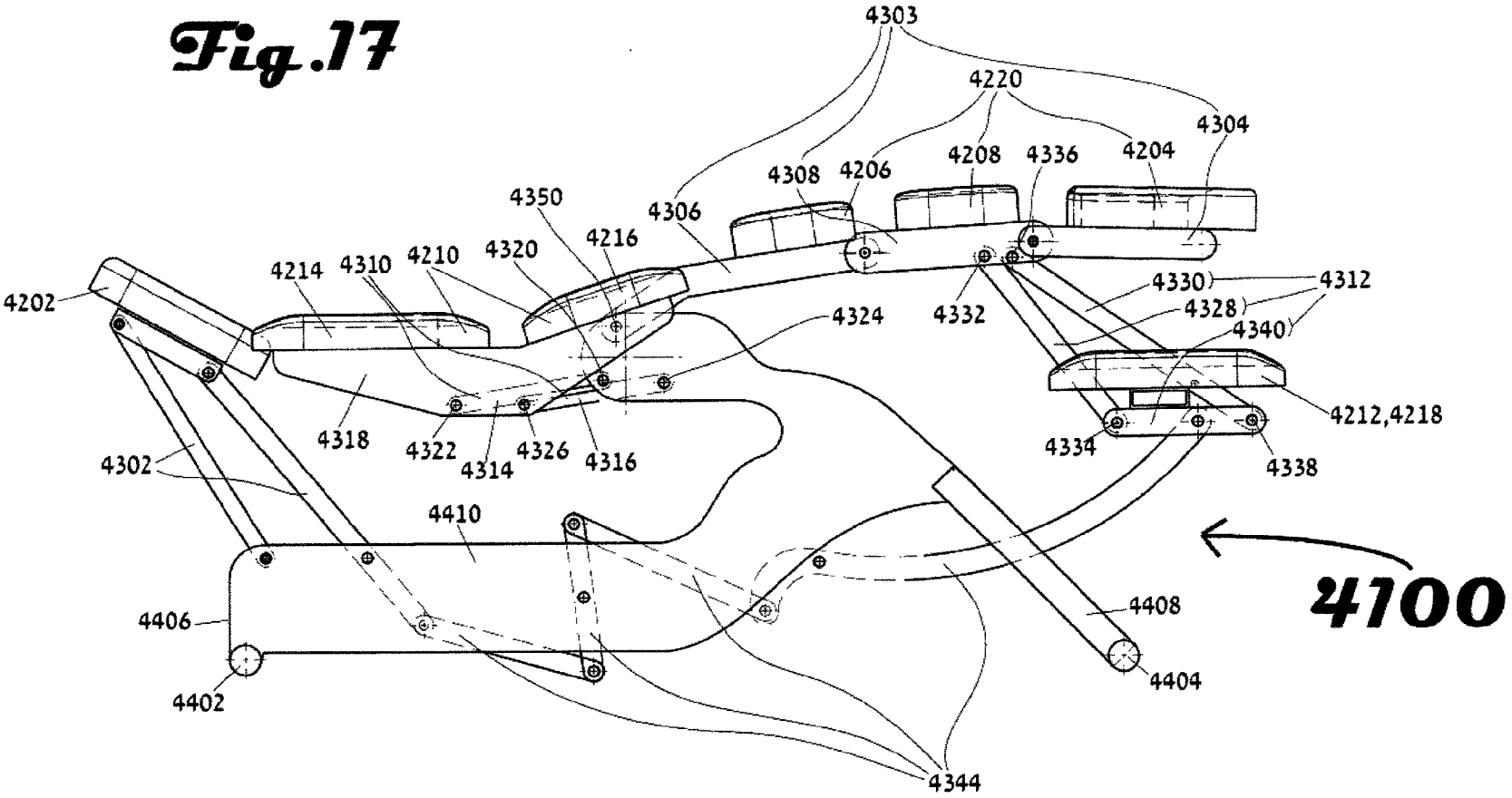
FIG. 17 is a schematic illustration showing a right side elevation view of the fifth articulated therapeutic apparatus shown in FIG. 16, in which the fifth therapeutic apparatus may be seen in a prone position.

Attention is presently drawn to FIGS. 16 and 17, schematically illustrating a fifth of several possible, exemplary, neither exhaustive nor limiting embodiments of an articulated therapeutic apparatus 4100 according to the present disclosure, in a seated position, and in a prone position, respectively. Similar features for the fifth articulated therapeutic apparatus 4100 have been given reference numerals that are the reference numerals used for the articulated therapeutic apparatus 100 increased by 4000.

The fifth articulated therapeutic apparatus may comprise an optional arm support mechanism 4312 which may be hinged to a torso mechanism 4303 extending from a pelvic hinge 4350 connecting the torso mechanism with a base spine 4410. The torso mechanism 4303 may comprise an abdomen member 4306 extending away from the pelvic hinge 4350 towards a head member 4304 with an optional chest member 4308 linked therebetween. The optional arm support mechanism 4312 may be hinged to the torso mechanism 4303 adjacent the head member 4304 and may comprise a rearward arm member 4328 and a forward arm member 4330. The rearward arm member 4328 may extend between a rearward mechanism end 4332 which may connect to the torso mechanism 4303 and a rearward link end 4334. Similarly, the forward arm member 4330 may extend between a forward mechanism end 4336 connected to the torso mechanism 4303 and a forward link end 4338. An intermediate arm member 4340 may be connected to, and may extend between, the rearward link end 4334 and the forward link end 4338. Each of the intermediate arm members 4340 supports its respective arm support 4212.

The optional arm support mechanism 4312 may comprise optional right and left arm support mechanism **4312*r*, 4312*l* respectively interconnected to the optional right and left arm supports 4212*r*, 4212*l*. The optional right and left arm support mechanism 4312*r*, 4312*l* may move independently of each other and/or in a coordinated manner therebetween, and/or coordinated with the move of the torso rest 4220 and/or the seat 4202**.

In a prone position (FIG. 17) the optional arm supports 4212 may move generally forwardly relative to the pelvic hinge 4350. The intermediate arm member 4340 of the optional arm support mechanism 4312 may be coupled to, and/or linked with, the seat mechanism 4302 by a second linkage system 4344. Generally, the second linkage system 4344 may be effected and/or realized either mechanically, hydraulically, pneumatically and/or electrically through a system comprising levers and/or links and/or hinges and/or actuators and/or any combination thereof.

The second linkage system 4344 may transfer and/or coordinate motion between the intermediate arm member 4340 and thus the optional arm support mechanism 4312, and the seat mechanism 4302, so that when the intermediate arm member 4340 (which, in turn, is associated, and move, with the optional arm support mechanism 4312) moves from a substantially upright posture in a seated position towards a substantially extended posture in a prone position, the seat mechanism 4302 may move away from a substantially folded posture in the seated position towards a substantially extended posture in the prone position in a coordinated manner. This motion too may be effected either unassisted, i.e., in a pure mechanical manner, or assisted (either hydraulically, pneumatically, and/or electrically) and/or any combination thereof by seat and/or torso actuator (not shown). The leg mechanism 4310 may move in a coordinated manner with the seat mechanism 4302 and/or the torso mechanism 4303, with the movement of the leg mechanism 4310 may be effected by a leg actuator (not shown).

Figure 18:
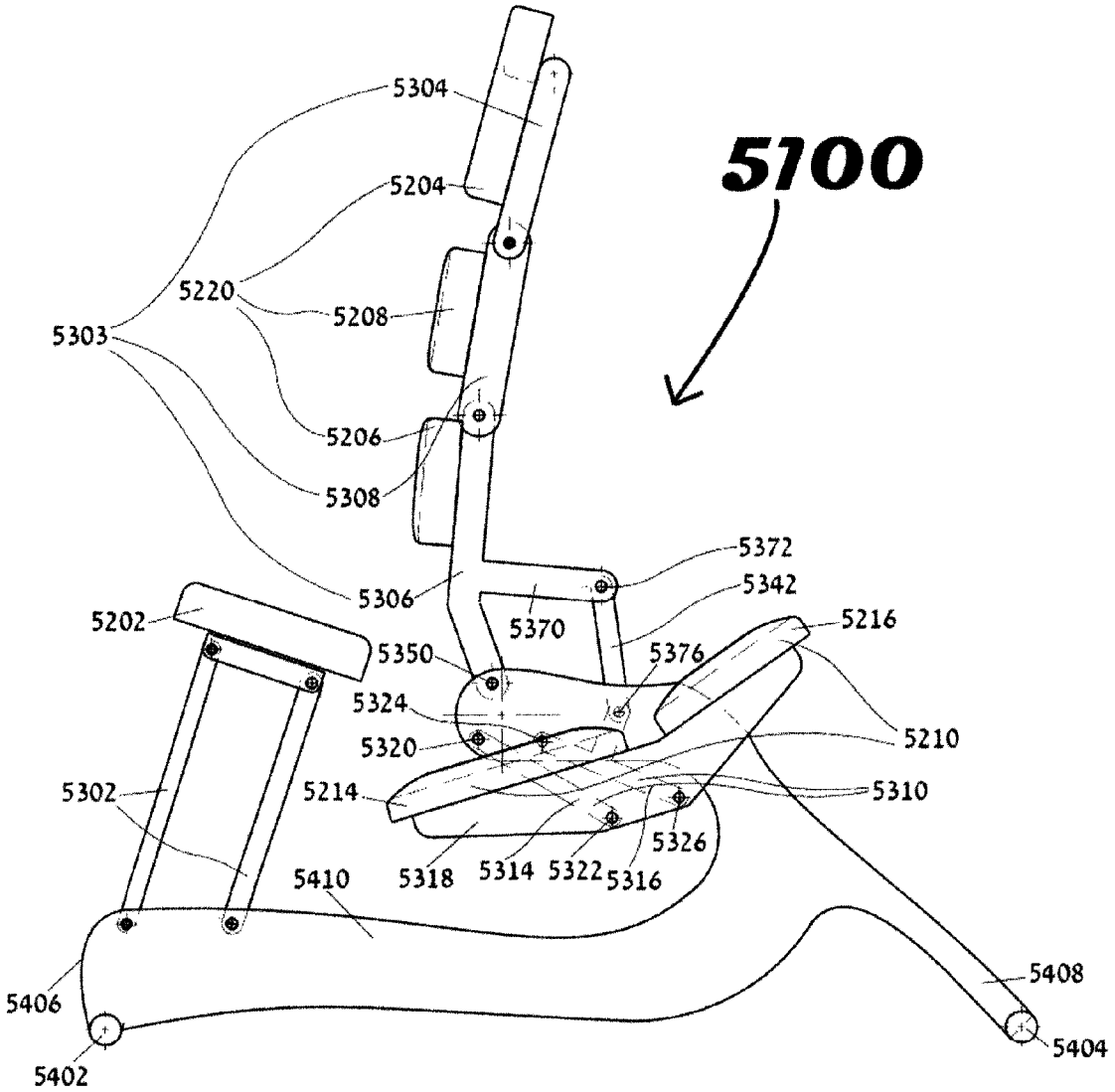
FIG. 18 is a schematic illustration showing a right side elevation view of a sixth of several possible, exemplary, neither exhaustive nor limiting embodiments of a modified therapeutic apparatus according to the present disclosure, in which the sixth therapeutic apparatus may be seen in a seated position.
Figure 19:
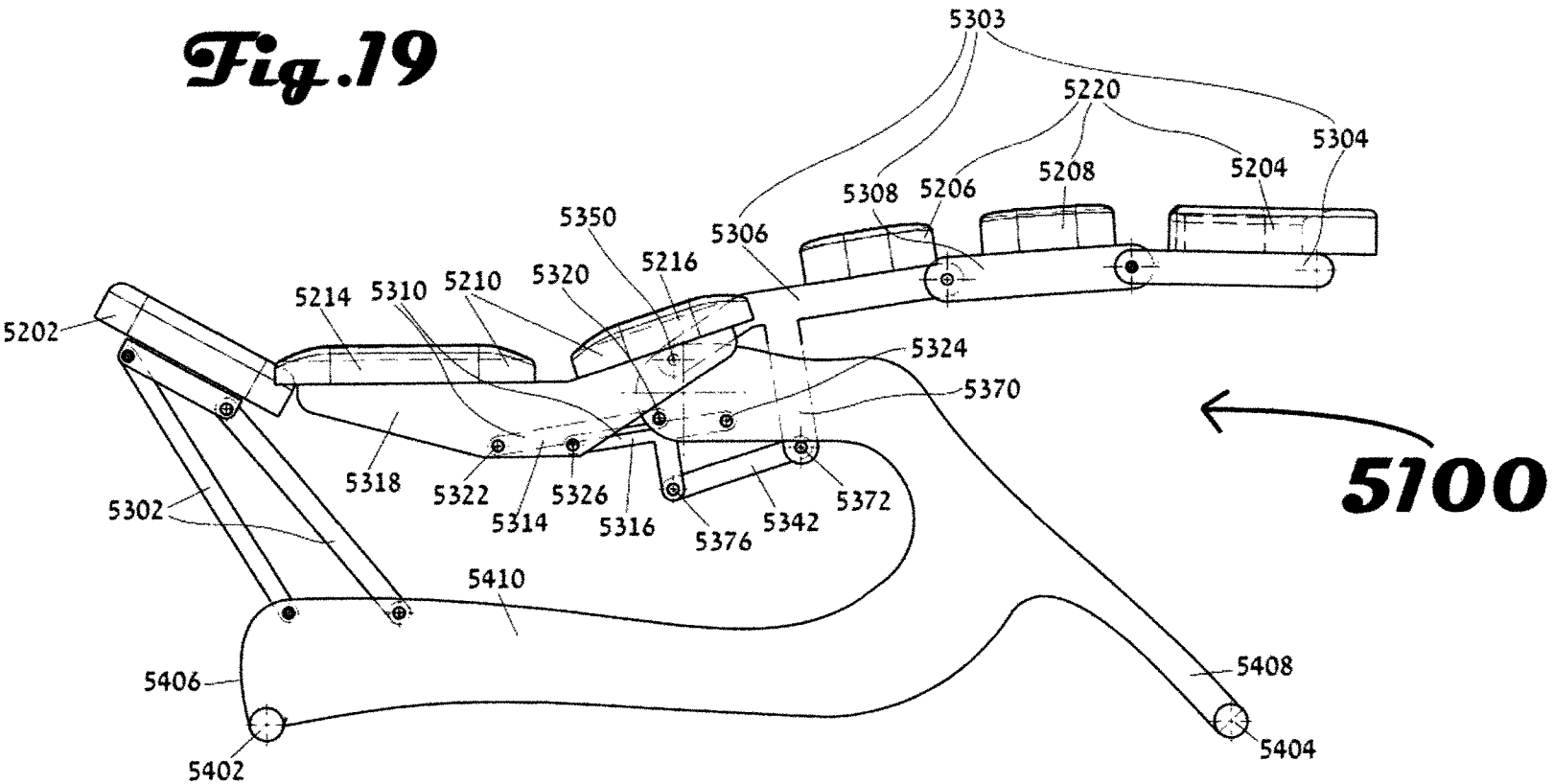
FIG. 19 is a schematic illustration showing a right side elevation view of the sixth modified therapeutic apparatus shown in FIG. 18, in which the sixth therapeutic apparatus may be seen in a prone position.

Attention is presently directed to FIGS. 18 and 19, schematically illustrating a sixth of several possible, exemplary, neither exhaustive nor limiting embodiments of a modified therapeutic apparatus 5100 according to the present disclosure, in a seated position, and in a prone position, respectively. Similar features for the sixth modified therapeutic apparatus 5100 have been given reference numerals that are the reference numerals used for the articulated therapeutic apparatus 100 increased by 5000.

A torso mechanism 5303 of the sixth modified therapeutic apparatus 5100 may further comprise a lug 5370 extending generally transversely to the torso mechanism 5303, optionally from an abdomen member 5306, away from an abdomen rest 5206, which may be mounted on the abdomen member 5306. The lug 5370 may be rigidly connected with the torso mechanism 5303 and/or the abdomen member 5306 and may be cantilevered, and extend away, therefrom, to a first linkage hinge 5372. A leg linkage 5342, extending between the first linkage hinge 5372 and a second linkage hinge 5376 may link the lug 5370 with a leg mechanism 5310, optionally a forward leg member 5316 of the leg mechanism 5310.

Movement of a torso mechanism 5303 and its related abdomen rest 5204, head rest 5206, and optional chest rest 5208 may be effected by a torso actuator and/or leg actuator (not shown) which may generally be connected between a base spine 5410 and the torso mechanism 5303 and/or the leg mechanism 5310 respectively. The leg mechanism 5310 moves with the torso mechanism 5303 while motion of the coordinated seat mechanism 5302 may be effected by a seat actuator (not shown) which may generally be connected between the base spine 5410 and a seat mechanism 5302. If and/or when employed, such actuators may be of any known or discovered type.

FIGS. 20 and 21 schematically illustrate a seventh of several possible, exemplary, neither exhaustive nor limiting embodiments of a modified therapeutic apparatus 6100 according to the present disclosure, in a seated position, and in a prone position, respectively. Similar features for the seventh modified therapeutic apparatus 6100 have been given reference numerals that are the reference numerals used for the articulated therapeutic apparatus 100 increased by 6000.

The seventh modified therapeutic apparatus 6100 may comprise a torso mechanism 6303, a leg mechanism 6310 and a seat mechanism 6302, linking a base spine 6410 with the torso, leg and seat rests 6220, 6310, 6302 respectively.

Movement of a torso mechanism 6303 and its related abdomen rest 6204, head rest 6206, and optional chest rest 6208 may be effected by a torso actuator (not shown) which may generally be connected between the base spine 6410 and the torso mechanism 6303. Similarly, movement of the leg mechanism 6310 may be effected by a leg actuator and/or actuators (not shown) while motion of the seat mechanism 6302 may be effected by a seat actuator (not shown). Such actuators may generally be connected between the base spine 6410 and the torso mechanism 6303, seat mechanism 6302 and/or leg mechanism 6310. If and/or when employed, such actuators may be of any known or discovered type. Movement of the torso mechanism 6303, seat mechanism 6302 and/or leg mechanism 6310 is intended to be simultaneous and/or coordinated.

All directional references (such as, but not limited to, upper, lower, upward, downward, left, right, leftward, rightward, top, bottom, above, below, vertical, horizontal, clockwise, and counterclockwise, tangential, axial and/or radial, or any other directional and/or similar references) are only used for identification purposes to aid the reader's understanding of the embodiments of the present disclosure, and may not create any limitations, particularly as to the position, orientation, or use unless specifically set forth in the claims. Similarly, joinder references (such as, but not limited to, attached, coupled, connected, and the like) are to be construed broadly and may include intermediate members between a connection of elements and relative movement between elements. As such, joinder references may not necessarily infer that two elements are directly connected and in fixed relation to each other.

In some instances, components are described with reference to "ends" having a particular characteristic and/or being connected with another part. However, those skilled in the art will recognize that the present disclosure is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like.

Additionally, all numerical terms, such as, but not limited to, "first", "second", "third", or any other ordinary and/or numerical terms, should also be taken only as identifiers, to assist the reader's understanding of the various embodiments, variations and/or modifications of the present disclosure, and may not create any limitations, particularly as to the order, or preference, of any embodiment, variation and/or modification relative to, or over, another embodiment, variation and/or modification.

Similarly, adjectives such as, but not limited to, "articulated", "modified", or similar, should be construed broadly, and only as nominal, and may not create any limitations, not create any limitations, particularly as to the description, operation, or use unless specifically set forth in the claims.

While the entire discussion relates to a seated position as a first position, and to a prone position as a second, or final, position, the opposite may equally apply, i.e., the patient may be initially positioned in the prone position, and transferred passively to the seated position. Additionally, the patient may be positioned on the therapeutic apparatus in any interim position, and transferred substantially passively to any other position, either any interim position between the seated and prone positions, or the first and second positions themselves.

In methodologies directly or indirectly set forth herein, various steps and operations are described in one possible order of operation, but those skilled in the art will recognize that steps and operations may be rearranged, replaced, or eliminated without necessarily departing from the spirit and scope of the present disclosure as set forth in the claims. It is intended that all matter contained in the above description or shown in the accompanying drawings shall be interpreted as illustrative only and not limiting. Changes in detail or structure may be made without departing from the spirit of the present disclosure as defined in the appended claims.

While certain exemplary embodiments have been described and shown in the accompanying drawings, it is to be understood that such embodiments are merely illustrative of and not restrictive on the broad present disclosure, and that this present disclosure not be limited to the specific constructions and arrangements shown and described, since various other modifications and/or adaptations may occur to those of ordinary skill in the art. It is to be understood that individual features shown or described for one embodiment may be combined with individual features shown or described for another embodiment. It is to be understood some features are shown or described to illustrate the use of the present disclosure in the context of functional elements and such features may be omitted within the scope of the present disclosure and without departing from the spirit of the present disclosure as defined in the appended claims.

The invention claimed is:

1. Apparatus for assisting a person to be transitioned between an upright sitting position to a horizontal prone position, comprising:

a fixed base having a first forward end and a second rearward end;

a seat attached to said fixed base and movable relative to said fixed base;

a torso rest attached to said fixed base and movable with respect to said fixed base between an upright position, at which time said seat is disposed at a first position relative to said fixed base, so as to permit a person's front torso portion to be engaged with and supported upon said torso rest when the person is seated in an upright position and facing toward said torso rest, and a horizontal prone position, at which time said seat is disposed at a second position, so as to support the person's front torso portion in a horizontal prone position when the person is disposed in a prone position; and right and left leg supports for supporting the right and left legs, respectively, of the person disposed upon the apparatus, wherein said right and left leg supports are movable with respect to said fixed base;

wherein said seat, said torso rest, and said right and left leg supports are movable with respect to said fixed base in a coordinated manner so as to transitionally move the person in a supported manner between said seated upright position and said horizontal prone position as a result of the person's front torso portion being engaged with and supported by said torso rest.

2. The apparatus of claim 1, wherein:

a seat mechanism connects said seat to said base at a position adjacent to said second rearward end of said base; and a leg mechanism, interlinking said leg supports to said base, is disposed forwardly relative to said seat mechanism.

3. The apparatus of claim 2, wherein:

a torso mechanism movably connects said torso rest to said base at a position interposed between said first end and said second end of said base.

4. The apparatus of claim 3, further comprising:

arm rests connected to said torso mechanism and being movable in a coordinated manner with said torso, seat, and leg mechanisms.

5. The apparatus of claim 4, further comprising:

an arm support mechanism operatively associated with said arm rests and hingedly connected to said torso mechanism and said seat mechanism so as to coordinate movement between said arm support mechanism, said torso mechanism, and said seat mechanism.

6. The apparatus of claim 5, wherein:

said leg mechanism, said seat mechanism, and said arm support mechanism are operatively connected together so as to coordinate movement between said leg mechanism, said seat mechanism, and said arm support mechanism.

7. The apparatus of claim 3, wherein:

said torso mechanism connects to said leg mechanism by a leg linkage so as to effect a coordinated movement between said torso mechanism and said leg mechanism.

8. The apparatus of claim 3, wherein:

said torso mechanism is operatively connected to said seat mechanism so as to coordinate movement between said torso mechanism and said seat mechanism.

9. The apparatus of claim 3, wherein;

said seat mechanism, said torso mechanism, and said leg mechanism move continuously between said seated position and said prone position.

10. The apparatus of claim 9, wherein:

a prone extent of said apparatus, when said apparatus is disposed in said prone position, is greater than a seated extent of said apparatus when said apparatus is disposed in said seated position.

11. The apparatus as set forth in claim 1, further comprising:

a head rest for supporting a portion of the person's face when the person is disposed in said prone position.

* * * * *